US007789479B2

(12) United States Patent
Samoto

(10) Patent No.: US 7,789,479 B2
(45) Date of Patent: Sep. 7, 2010

(54) IMAGE RECORDING APPARATUS

(75) Inventor: Kenji Samoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 904 days.

(21) Appl. No.: 11/623,805

(22) Filed: Jan. 17, 2007

(65) Prior Publication Data

US 2007/0165061 A1 Jul. 19, 2007

(30) Foreign Application Priority Data

Jan. 17, 2006 (JP) ..... 2006-008303

(51) Int. Cl.
*B41J 2/015* (2006.01)

(52) U.S. Cl. ..... 347/20

(58) Field of Classification Search ..... None
See application file for complete search history.

(56) References Cited

U.S. PATENT DOCUMENTS 5,907,343 A * 5/1999 Takemura et al. ..... 347/108

FOREIGN PATENT DOCUMENTS

| | | | |
|---|---|---|---|
| JP | 5077514 | A | 3/1993 |
| JP | 2002011918 | A | 1/2002 |
| JP | 2003011340 | A | 1/2003 |
| JP | 2005081691 | A | 3/2005 |

* cited by examiner

*Primary Examiner*—Stephen D Meier
*Assistant Examiner*—Alexander C Witkowski
(74) *Attorney, Agent, or Firm*—Baker Botts L.L.P.

(57) ABSTRACT

An image recording apparatus has a recording head for recording an image on a recording medium, an ink supply source for supplying an ink to the recording head through an ink tube, a carriage for mounting the recording head thereon reciprocating in a primary scanning direction, and first and second guide members for supporting the carriage thereacross and guiding reciprocating movement of the carriage. The apparatus includes a scale provided on the second guide member along the primary scanning direction, a detector provided on the carriage for detecting a reciprocating position of the carriage in corporation with the scale, and a partition disposed in the vicinity of the scale for separating at least a part of the ink tube from the scale.

17 Claims, 16 Drawing Sheets

IMAGE RECORDING APPARATUS

CROSS-REFERENCE OF RELATED APPLICATION

This non-provisional application claims priority under 35 U.S.C. §119(a) on Patent Application No. 2006-008303 in Japan on Jan. 17, 2006, the entire contents of which are hereby incorporated by reference.

BACKGROUND

The present invention relates to an image recording apparatus, which is provided with a linear encoder for detecting a position and a moving rate of a carriage in the case of recording an image while reciprocating a carriage having a recording head of an ink jet type mounted thereon in a direction orthogonal to a conveying direction of a recording medium.

As a conventional image recording apparatus, for example as disclosed in Japanese Patent Application Laid-Open No. H05-077514 (Refer to FIG. 1 and FIG. 3) and Japanese Patent Application Laid-Open No. 2005-081691 (Refer to FIG. 2, FIG. 3, and FIG. 4), a linear scale of on optical system linear encoder extending along a primary scanning direction in order to detect a position and a moving rate of a carriage having a recording head of an ink jet type mounted thereon has been well known.

In Japanese Patent Application Laid-Open No. 2005-081691 (Refer to FIG. 2, FIG. 3, and FIG. 4), a guide shaft formed in a round shank for reciprocatably supporting a carriage to discharge ink drops toward a lower side in a primary scanning direction and a shield plate for reciprocatably driving the carriage, which is longer than a belt for conveyance of a recording head in a horizontal direction, are arranged. A band-like scale (a tape scale) is extended so as to pass through an optical sensor part provided on a side surface in a longitudinal direction of the carriage, and the shield plate is arranged so as to partition the belt for conveyance of the recording head (a no-end belt) and the tape scale.

In addition, as shown in Japanese Patent Application Laid-Open No. 2003-011340 (Refer to FIG. 1, FIG. 2, and FIG. 3), a printer apparatus having an ink cartridge which is left at rest in a main body housing of the printer apparatus and connecting a carriage thereto by means of an ink supply tube has been publicly known.

BRIEF SUMMARY

However, due to a minute ink drop injected from a recording head upon the image recording operation, an ink mist (a misty floating ink) floating within the main body of the apparatus adheres to the linear encoder, so that accuracy of detection of a scale tends to be largely lowered.

For example, in Japanese Patent Application Laid-Open No. 2005-081691 (Refer to FIG. 2, FIG. 3, and FIG. 4), since distances in height from a position of a recording head up to a tape scale and an optical sensor part are short, the ink mist easily adheres to the tape scale and the optical sensor part and the accuracy of detection of the linear encoder is easily deteriorated.

The carriage in Japanese Patent Application Laid-Open No. 2005-081691 (Refer to FIG. 2, FIG. 3, and FIG. 4) has the recording head on the lower surface side and an ink tank on the upper surface side. On the other hand, in Japanese Patent Application Laid-Open No. 2003-011340 (Refer to FIG. 1, FIG. 2, and FIG. 3), the reciprocating carriage is connected to the ink tank which is left at rest within the printer apparatus through an ink supply tube (an ink supply pipe) capable of being curved (having a flexibility). In this case, even if a shield plate is provided between the tape scale and the no-end belt for conveyance of the recording head, when the ink supply tube and the tape scale are arranged in proximity with each other, the curved portion of the ink supply tube scrapes against the surface of the tape scale and the ink easily adheres to the surface of the tape scale. Accordingly, the accuracy of detection of the linear encoder is easily lowered or deteriorated.

In order to solve the above-described problems, an object is to provide an image recording apparatus, which is constituted so as to make adhesion of the ink mist to the tape scale itself less and so as to be capable of reliably prevent lowering of the detection accuracy of the linear encoder by preventing contact between the tape scale and the ink supply tube.

In order to attain the purpose, there is provided an image recording apparatus according to an aspect, comprising: a recording head which can record an image on a recording medium; an ink supply source for supplying an ink to the recording head through an ink tube; a carriage for mounting the recording head thereon, which can reciprocate in a primary scanning direction; first and second guide members for supporting the carriage across the first and second guide members and guiding reciprocating movement of the carriage, wherein the second guide member is arranged on the downstream side lower than the first guide member in a subsidiary scanning direction orthogonal to the primary scanning direction; a scale which is arranged on the second guide member along the primary scanning direction; a detector which is disposed on the carriage, for detecting a reciprocating position of the carriage in corporation with the scale; and a partition which is arranged in the vicinity of the scale, for separating at least a part of the ink tube from the scale.

According to the aspect, when the carriage is moving along the primary scanning direction, even if the ink supply tube is moved along with movement of the carriage, the ink supply tube is merely brought into contact with a partition wall. Thus, it does not prevent the smooth movement of ink supply tube. Then, it has an advantage such that the surface of the tape scale and the ink supply tube are not brought into contact with each other because they are blocked by a partition wall; and the detection accuracy of the linear encoder is not deteriorated (lowered) when the ink adheres to the surface of the tape scale.

The above and further objects and features will more fully be apparent from the following detailed description with accompanying drawings.

DETAILED DESCRIPTION

Figure 1:
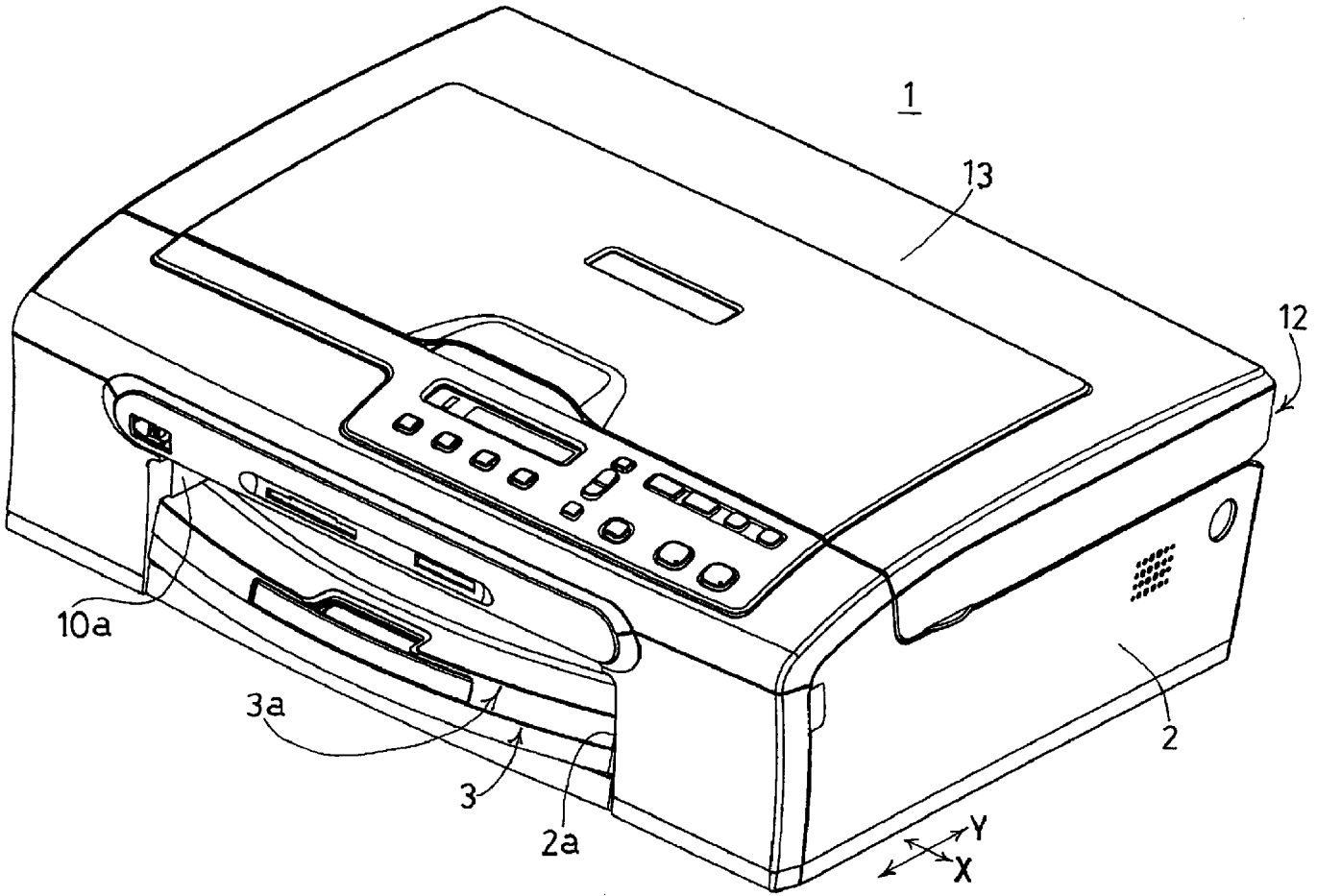
FIG. 1 is a perspective view of an image recording apparatus according to an embodiment.

An image recording apparatus 1 according to an embodiment is an aspect of to a multi function device (MFD), which is provided with a printer function, a copy function, a scanner function, and a facsimile function. As shown in FIG. 1, on a bottom of a main body of a recording apparatus 2 made of a synthetic resin of the apparatus, a sheet feeding cassette 3 which can be inserted from an opening portion 2*a* on the front side (the left side in FIG. 1) of the main body of the recording apparatus 2 is arranged. Hereinafter, the side where the opening portion 2*a* is located is referred to as a front side or a front portion and on the basis of this, the front side, right and left sides, and a rear side of the apparatus are determined.

According to the present embodiment, a plurality of sheets P as a recording medium which is cut into, for example, into an A4 size, a letter size, a legal size, and a card size is laminated (accumulated) and stored in the sheet feeding cassette 3 so that its shorter side extends in a direction (a direction orthogonal to a paper surface, a primary scanning direction, and an X axial direction in FIG. 1) orthogonal to a direction for conveyance of the sheet (a side scanning direction, hereinafter, referred to as a Y axial direction) (refer to FIG. 1).

Further, on the front end of the upper portion of the sheet feeding cassette 3, a supplemental cassette 3*a* for conveyance of a plurality of small-size sheets (not illustrated) so as to be accumulated is mounted movably in a Y axial direction. FIG. 1 shows the state that the supplemental cassette 3*a* is arranged at the position where the supplemental cassette 3*a* is not projected from the main body of the recording apparatus (a housing) 2 to the outside so as to be pressed into there.

Figure 2:
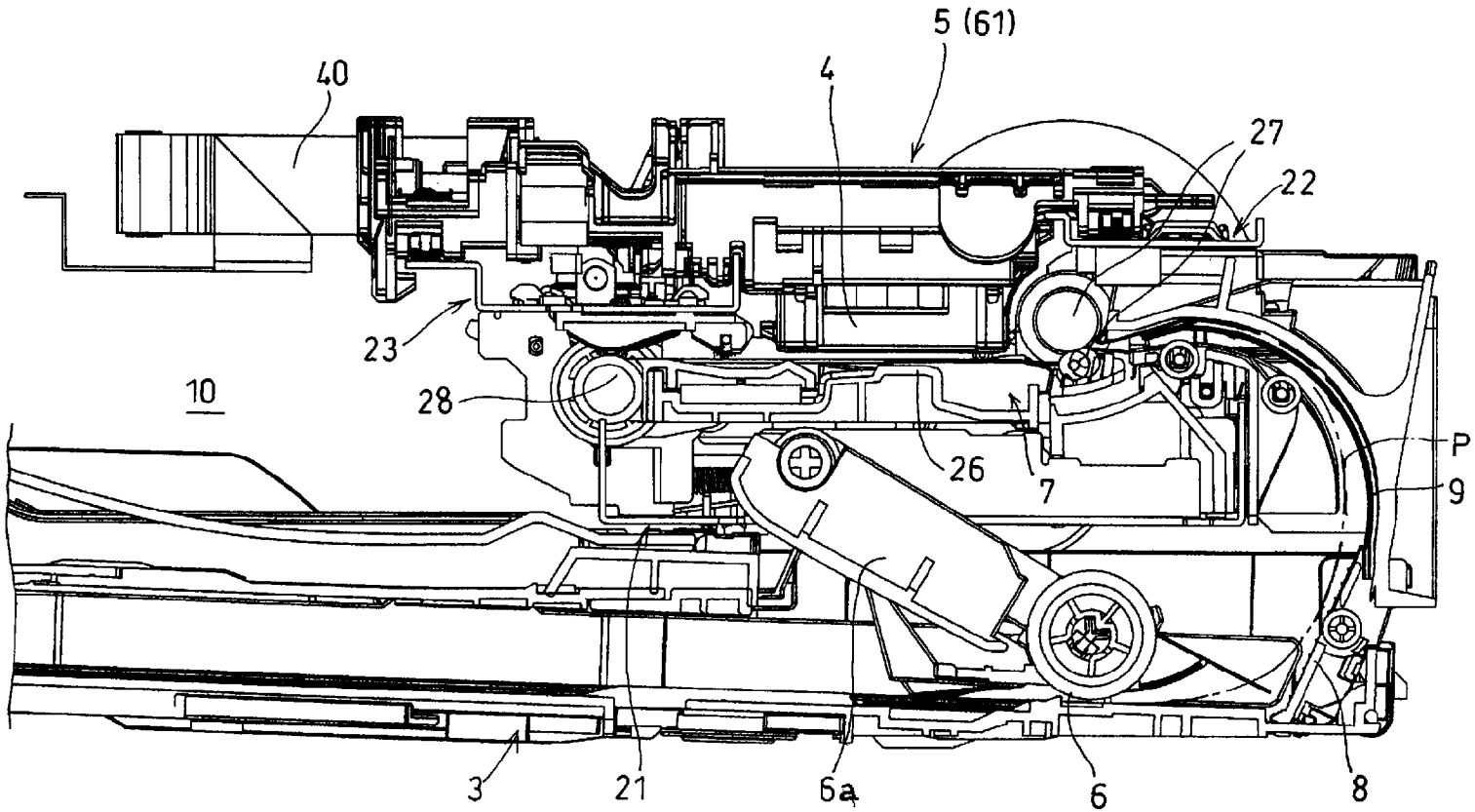
FIG. 2 is a partial notch side cross sectional view of a recording part.

In addition, on the back side of the sheet feeding cassette 3 (on the rear side in FIG. 1 and FIG. 2), a bank portion 8 for separating a sheet is arranged. Further, on the side of the main body of the recording apparatus 2, an arm 6*a* having its upper end capable of rotating in a vertical direction is fitted. The sheet P is separated and conveyed one-by-one, which is the recording medium accumulated on the sheet feeding cassette 3 and the supplemental cassette 3*a* by a sheet feeding roller 6 provided on the lower end of this arm 6*a* and an inclined separation plate 8. The separated sheet P is fed to a recording part 7 which is provided on the upper side (the high position) backward of the sheet feeding cassette 3 via an upper lateral U-turn path (a sheet feeding path) 9. The recording part 7 is formed by a carriage 5 or the like capable of reciprocating, on which a recording head of an ink jet type 4 for realizing a printer function or the like is mounted, as described later.

A sheet discharge part 10, on which the sheet P recorded by the recording part 7 is discharged with its recording surface turned around, is formed on the upper side of the supplemental cassette 3*a*, and a sheet discharge port 10*a* communicated with the sheet discharge part 10 (the upward of the opening portion 2*a*) is opened toward the front surface of the main body of the recording apparatus 2.

On the upper part of the main body of the recording apparatus 2, an image reading apparatus 12 for reading an original or the like in a copy function and a facsimile function is arranged.

On the upper side of the main body of the recording apparatus 2, an operation panel part 14 provided with various operational buttons and a liquid crystal display unit or the like is provided on the upper side of the image reading apparatus 12. The recording part 7, sheet discharge part 10, and an ink storage part 15 provided on one side of this sheet discharge part 10 are arranged so as to be located within a planar view projection area between the image reading apparatus 12 and the operation panel part 14.

On the upper surface of the image reading apparatus 12, a glass plate for mounting (not illustrated) is provided, which can mount the original thereon opening a document cover body 13 upward. On the lower side of the glass plate, an image scanner for reading the original (CIS: Contact Image Sensor) (not illustrated) is provided so as to be capable of reciprocating in a direction orthogonal to the paper surface of FIG. 1 (namely, a primary scanning direction, hereinafter, referred to as an X axial direction, and an axis extending in the primary scanning direction is referred to as an X axis).

The ink storage part 15 is released upward of the main body of the recording apparatus 2. In the ink storage part 15, an ink cartridge 19 shaped in an approximately rectangular box with a small area in a planar view and a high measurement to store each of four inks for recording in full colors can be stored along a Y axial direction into one line (reference numerals 19*a* to 19*d* are given to cartridges for respective colors, namely, Black (BK), Cyan (C), Magenta (M), and Yellow (Y), see FIG. 3). The ink storage part 15 is constituted so that the ink cartridge 19 can be attached or detached from above thereof.

Figure 4:
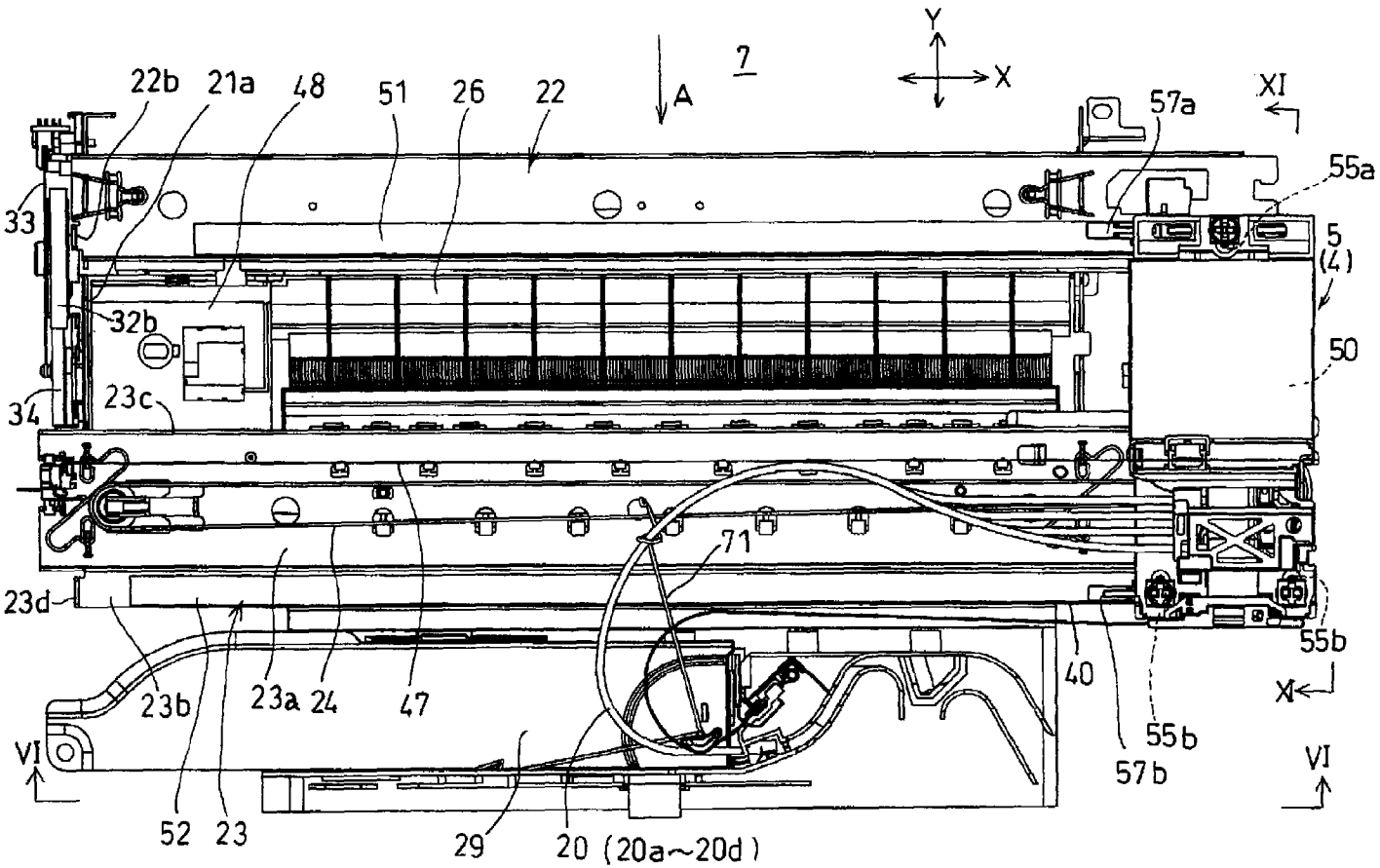
FIG. 4 is a plan view of the recording part with an upper cover body removed.
Figure 5:
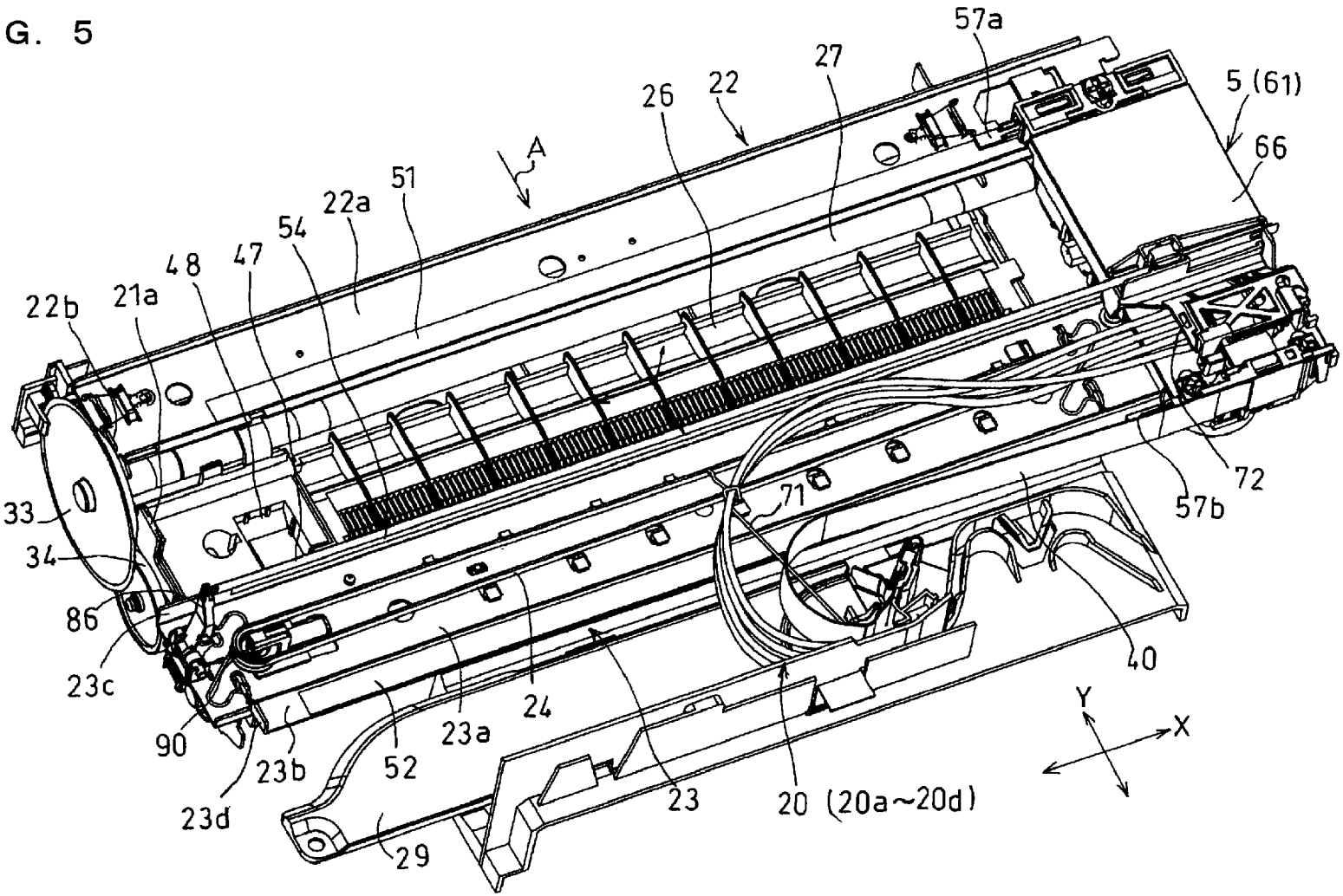
FIG. 5 is a perspective view of the recording part with the upper cover body removed.
Figure 6:
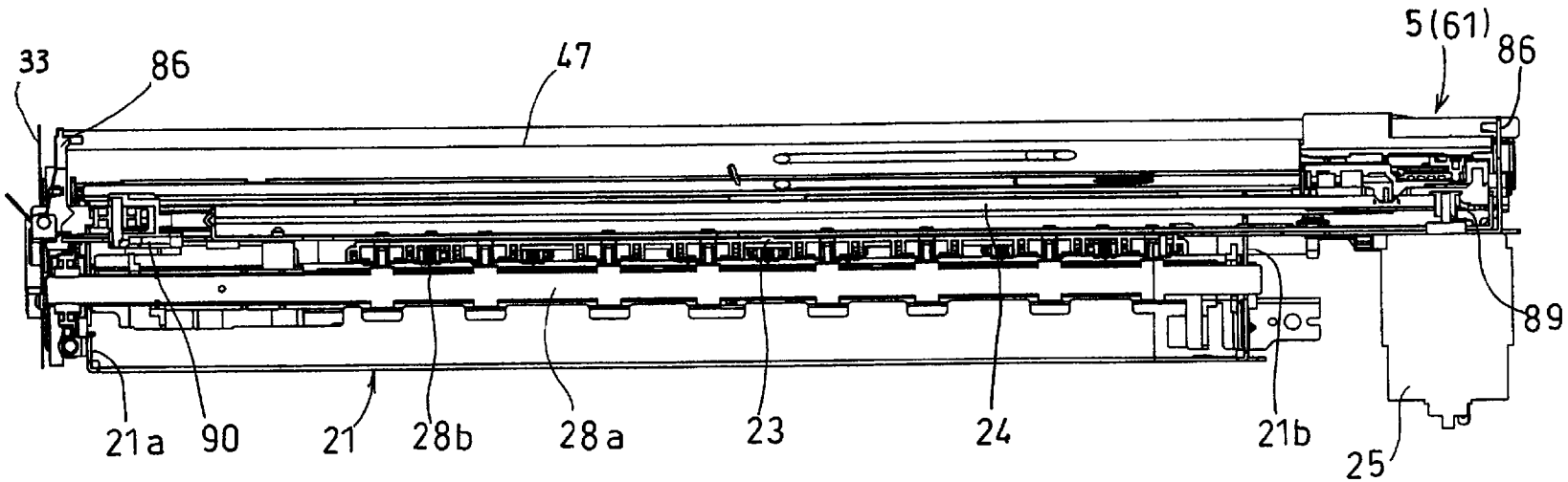
FIG. 6 is an arrow diagram taken on a line VI-VI of FIG. 4.

Then, ink is supplied from each ink cartridge 19 (represented by reference numerals 19*a* to 19*d*, individually) to the recording head of the ink jet type 4 via a plurality (four in the present embodiment) of ink supply tubes (ink tubes) 20 (represented by reference numerals 20*a* to 20*d*, individually, and refer to FIG. 4 and FIG. 5). Further, in the case of using more ink colors than four (six to eight colors or the like), the ink cartridge in response to the number of the ink color may be configured so as to be capable of being stored in the ink storage part (ink supply source) 15 and the ink supply tube 20 may be increased in response to the number of the ink cartridge.

As shown in FIGS. 3 to 16, the recording part 7 is supported by a pair of right and left side plates 21*a* and 21*b* in a frame-like main frame 21 with its upper surface released. This recording part 7 is provided with a horizontally-long platy first guide member 22 extending in the X axial direction (the primary scanning direction); a second guide member 23; a carriage 5 which is configured so as to be capable of reciprocating as being slidably supported across these both guide members 22 and 23; a timing belt (a no-end belt) 24 which is arranged on the upper surface of the second guide member 23 in parallel with the upper surface for reciprocating the carriage 5 on which the recording head 4 is mounted; a CR (carriage) motor 25 for driving this timing belt 24 (according to the embodiment, the CR motor 25 is a DC motor, however, other motor such as a stepping motor may be available); a platy platen 26 for supporting the sheet P to be conveyed at the lower surface side of the recording head 4; and a tape scale 47 which is a component of an optical linear encoder for detecting a position of the X axial direction (the primary scanning direction) of the carriage 5 and a moving rate of this direction arranged so as to extend along the primary scanning direction or the like. Further, on the upstream side of a sheet conveying direction (a direction of an arrow A, refer to FIG. 3, FIG. 4, and FIGS. 9 to 11) in a direction through which the sheet P passes on the platen 26, the first guide member 22 is arranged, and on the downstream thereof, the second guide member 23 is arranged.

The second guide member has a portion (an extension portion) including a horizontal wide chip 23*a*, which extends from an elongated portion including a guide chip 23*c* into a downstream in a subsidiary scanning direction. The horizontal wide chip 23*a* is a flat shape. A portion including the horizontal wide chip 23*a* (the extension portion) may be formed separately from a portion including the guide chip 23*c* of the second guide member, and the both portions may be fixed with each other by adhesion, welding, and screwing or the like.

Figure 12:
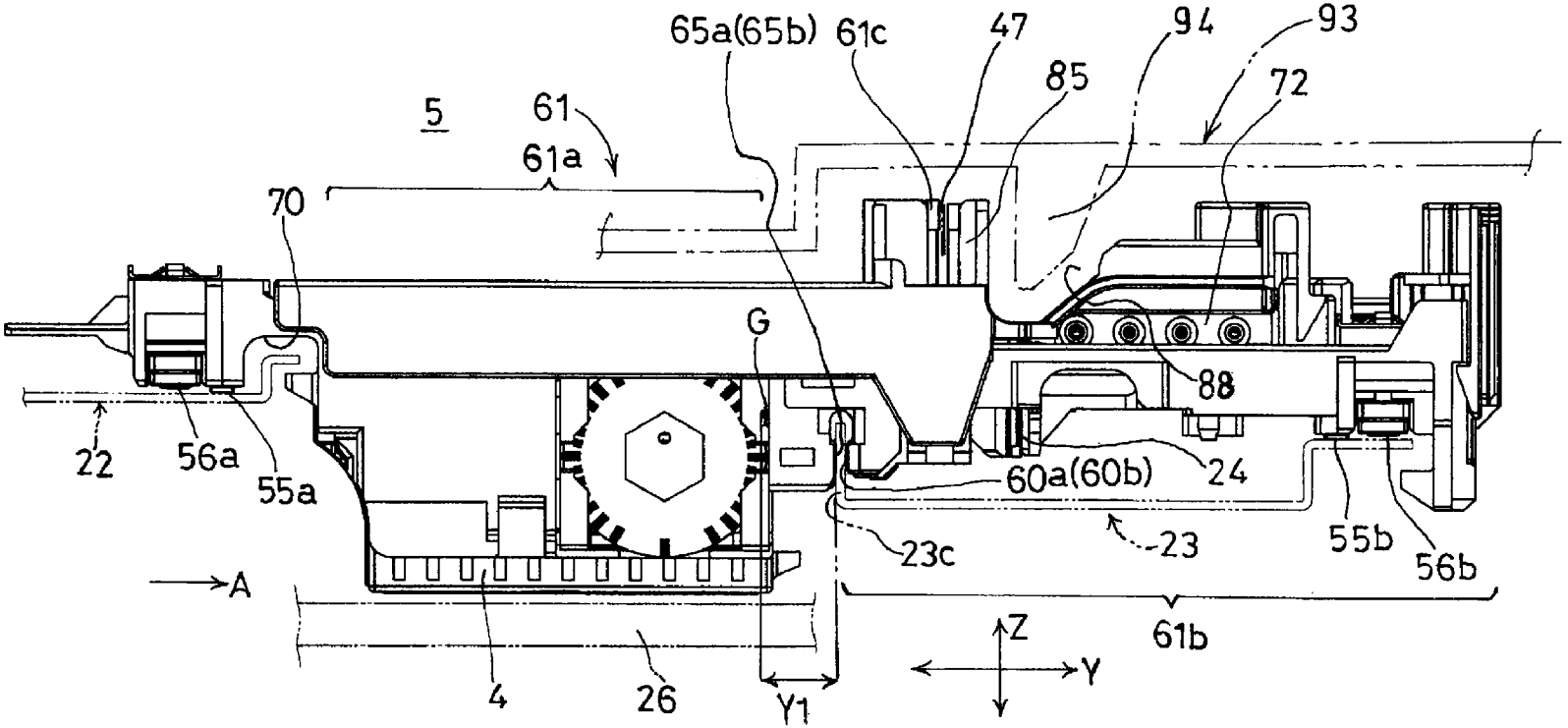
FIG. 12 is a left side view of a carriage.
Figure 13:
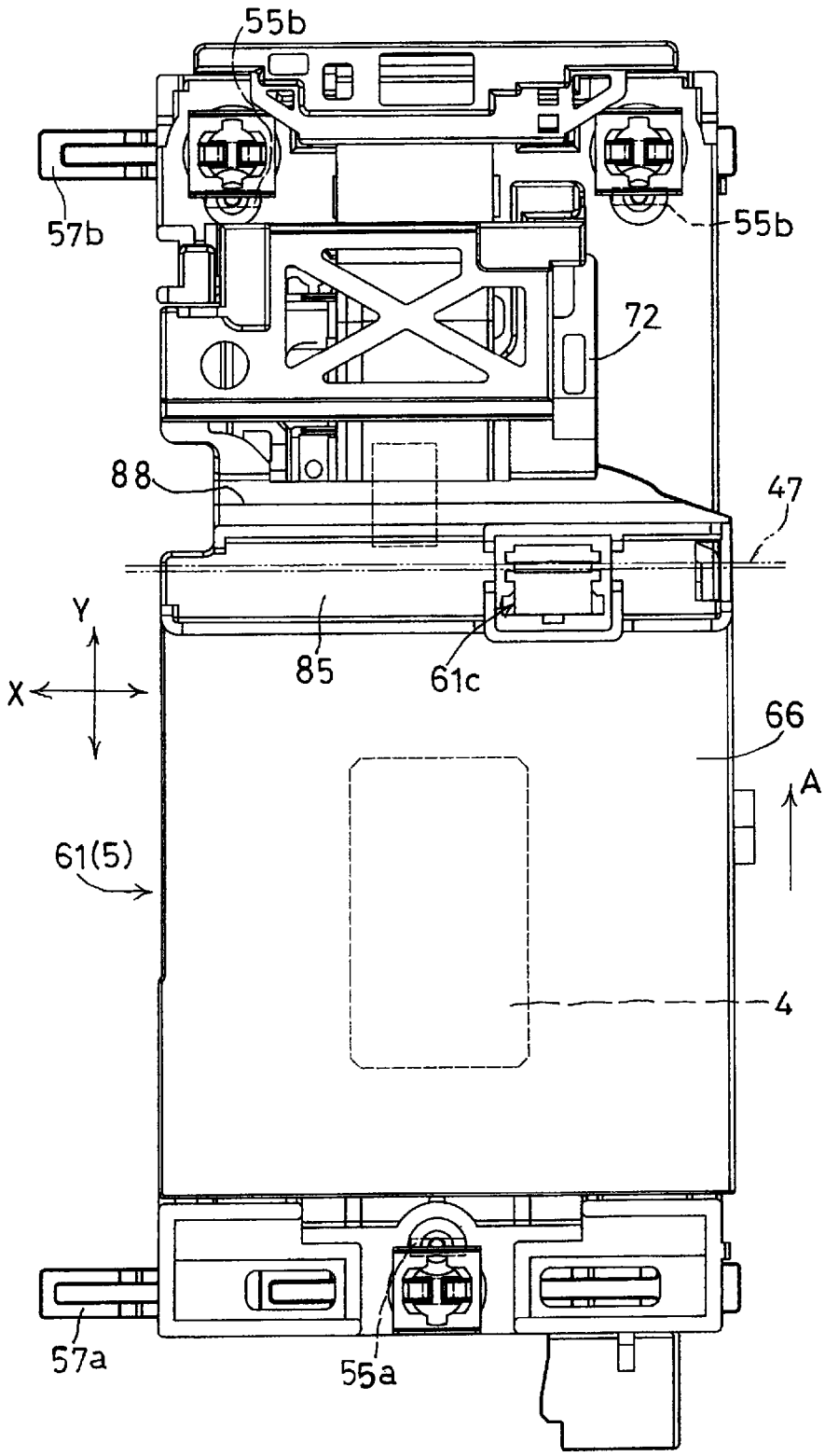
FIG. 13 is a plan view of the carriage.

In addition, as shown in FIG. 12 and FIG. 13 and to be described later, on the lower surface of the carriage 5 (a holder body 61), one fist sliding convex portion 55*a* and a pair of right and left second sliding convex portions 55*b* are arranged on respective apexes of a triangle so as to bridge over the first guide member 22 and the second guide member 23; the fist sliding convex portion 55*a* abuts against a first sliding surface 51 in the first guide member 22; and a pair of second sliding convex portions 55*b* abuts against a second sliding surface 52 in the second guide member 23. Further, a pair of right and left second sliding convex portions 55*b* is symmetrically provided at a distance for a measurement X1 across a center line OX in the X axial direction of the holder body 61 (refer to FIG. 13). Accordingly, in a planar view of the carriage 5 (or in a bottom view), a shape connecting respective center parts of one fist sliding convex portion 55*a* and a pair of right and left second sliding convex portions 55*b* is made into an isosceles triangle.

On the other hand, the lower surface sides of the first guide member 22 and the second guide member 23 extending along the primary scanning direction (the X axial direction) are connected by a par of side plates 21*a* and 21*b* extending in a subsidiary direction (the Y axial direction). Then, in order to enlarge a movable range in the X axial direction, furthermore, a recordable area in the X axial direction of the sheet P as much as possible while enlarging an interval in the X axial direction of the pair of right and left second sliding convex portions 55*b* (2X1), at least one side portion of the second guide member 23, preferably, the both end portions (according to the embodiment, right and left sides shown in FIG. 4 and FIG. 5) are elongated to the outside along the X axial direction above the side plates 21*a* and 21*b*. As a result, when the carriage 5 is located at a left end of the recording part 7 (namely, an ink receiver 48 to be described later), the second sliding convex portions 55*b* at the left side in the carriage 5 can be located at a left end portion of the second guide member 23 above the left side plate 21*a*.

In addition, a pair of resist rollers 27 is arranged on the upstream side of conveyance across the platen 26 to convey the sheet P into a gap between a nozzle surface on the lower surface of the recording head 4 and the platen 26. On the downstream side of the platen 26, a spur 28*b* contacting the upper surface of the sheet P and a sheet discharge roller 28*a* driven on the lower surface side are arranged and the recorded sheet P is conveyed to the sheet discharge part 10.

Further, as described above, in order to reduce the width measurement of the main body of the recording apparatus 2 while enlarging the movable range in the X axial direction of the carriage 5, the positions of the components arranged on one side or the opposite sides in the X axial direction of the main frame 21 are devised. According to the embodiment, as shown in FIGS. 4 to 6 and FIG. 8, a driving shaft (not illustrated) of a driving motor 31 for conveyance of a sheet, which is fixed on the inner surface of a left side plate 21*a*, is projected to the outer surface of the left side plate 21*a*. A motive energy is transmitted from a pinion gear 32*a* attached to this driving shaft to a first transmission gear 32*b* which is directly linked to a driving roller 27*a* of the pair of the resist rollers 27 in a concentric manner. The driving roller 27*a* is provided with a rotary encoder detection disk 33 with a large diameter, and the upper part of the rotary encoder detection disk 33 is projected from the upper surface of the left side plate 21*a* to the upper side. A no-end timing belt 35*c* is winded around a first pulley 35*a* which is directly linked to a middle gear 34 engaged with the first transmission gear 32*b* in a concentric manner and a second pulley 35*b* which is attached to the sheet discharge roller 28*a*. Further, reducing the diameter of the second pulley 35*b* as compared to the conventional one, the second pulley 35*b* is stored in a space between the outer surface of the left side plate 21*a* and the lower surface side of the second guide member 23 and the measurement in a horizontal direction of the entire recording part 7 is reduced.

Figure 3:
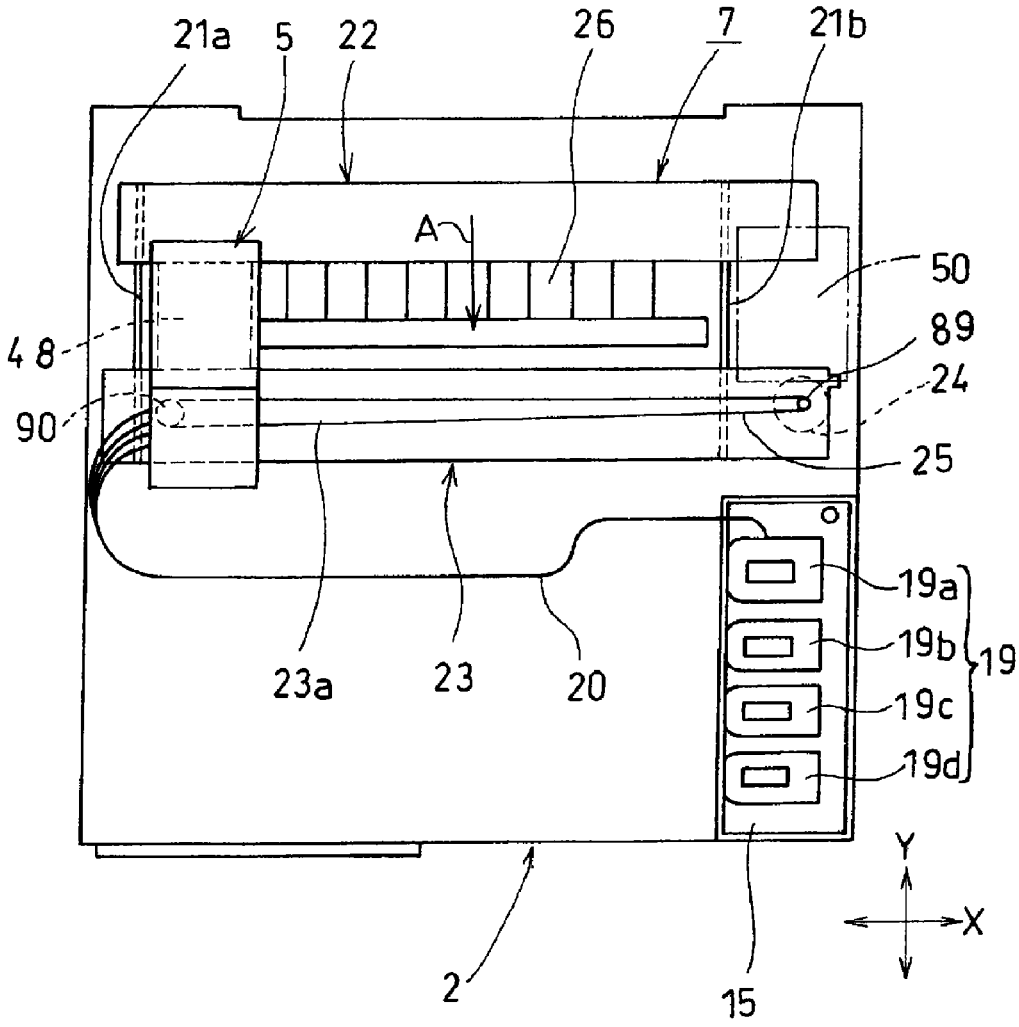
FIG. 3 is a plan view of a main body of the image recording apparatus with an image reading part removed.

In addition, on the outside of the width of the sheet P to be conveyed (the shorter side of the sheet P), the ink receiver 48 is arranged on one end side of the recording part 7 (according to the embodiment, the region near the left side plate 21*a* in FIG. 3 and FIG. 4), and a maintenance unit 50 is arranged on other end side (according to the embodiment, the region near the right side plate 21*a* in FIG. 3 and FIG. 5), respectively. Thereby, the recording head 4 may discharge the ink for periodically preventing clogging of a nozzle during the recording operation on a flashing position which is provided in the ink receiver 48 and the ink receiver receives the ink. On the part of the maintenance unit 50, the carriage 5 is located on a waiting position to carry out the recovery processing or the like for selectively absorbing the ink for each color and removing air bubbles within a buffer tank (not illustrated) on the recording head 4. In addition, a wiper (not illustrated) is provided in the maintenance unit 50 and cleaning of the nozzle surface of the recording head 4 is carried out when moving the carriage 5 from the portion of the maintenance unit 50 into an image recording area direction.

Figure 9:
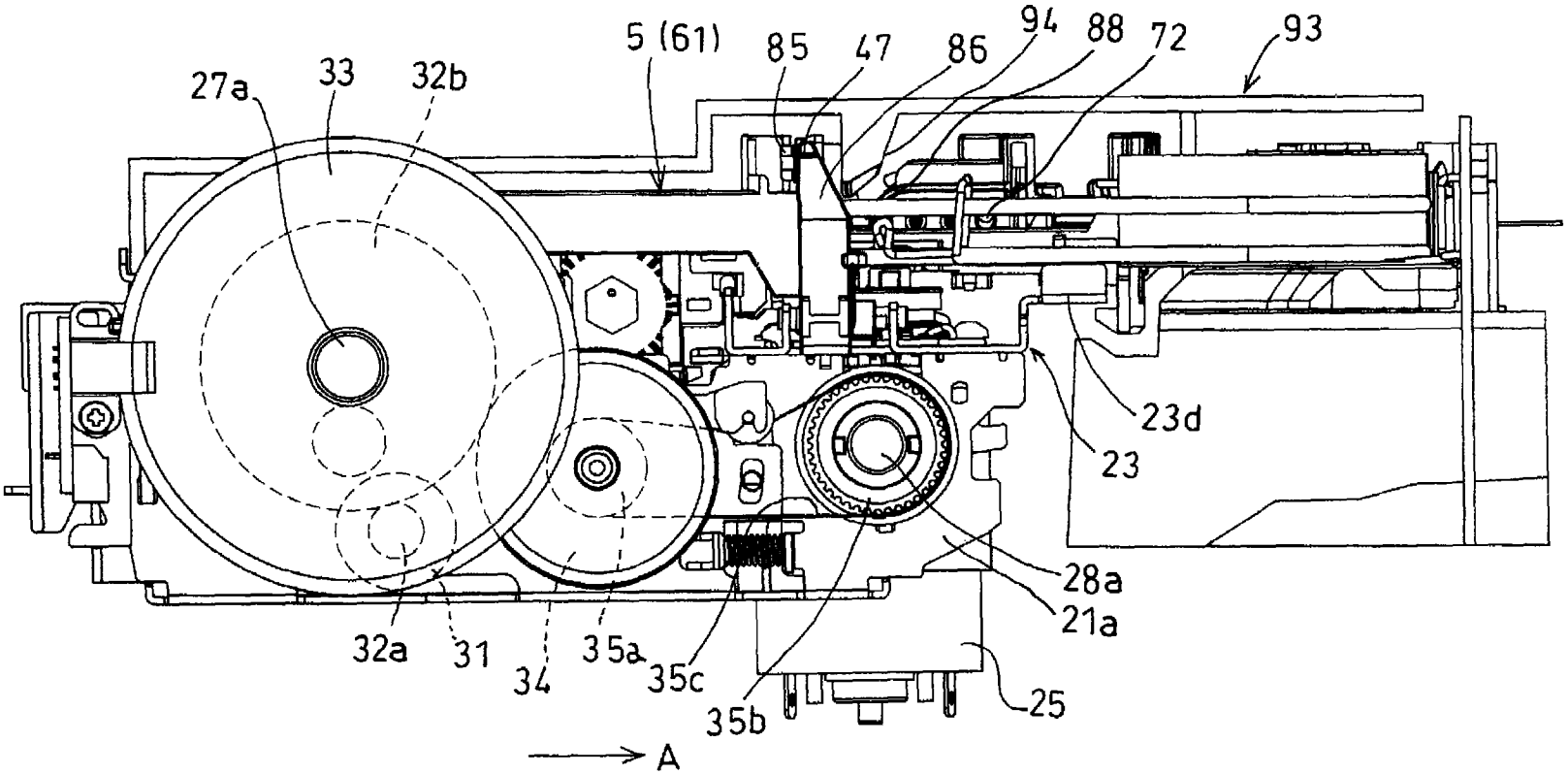
FIG. 9 is an arrow enlarged side cross sectional view taken on a line IX-IX of FIG. 7.
Figure 10:
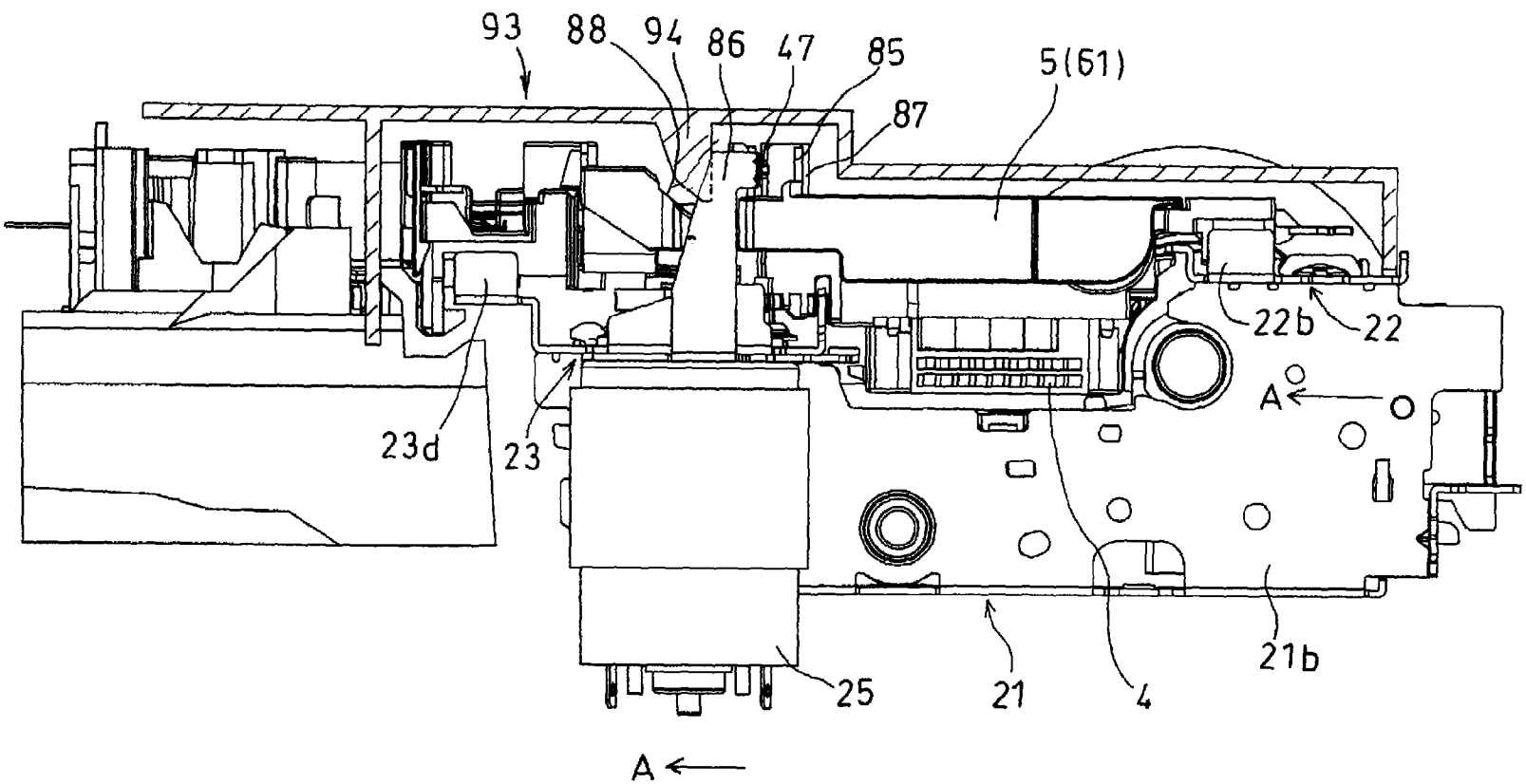
FIG. 10 is an arrow enlarged side sectional view taken on a line X-X of FIG. 7 for showing the cross section of the upper cover body.
Figure 11:
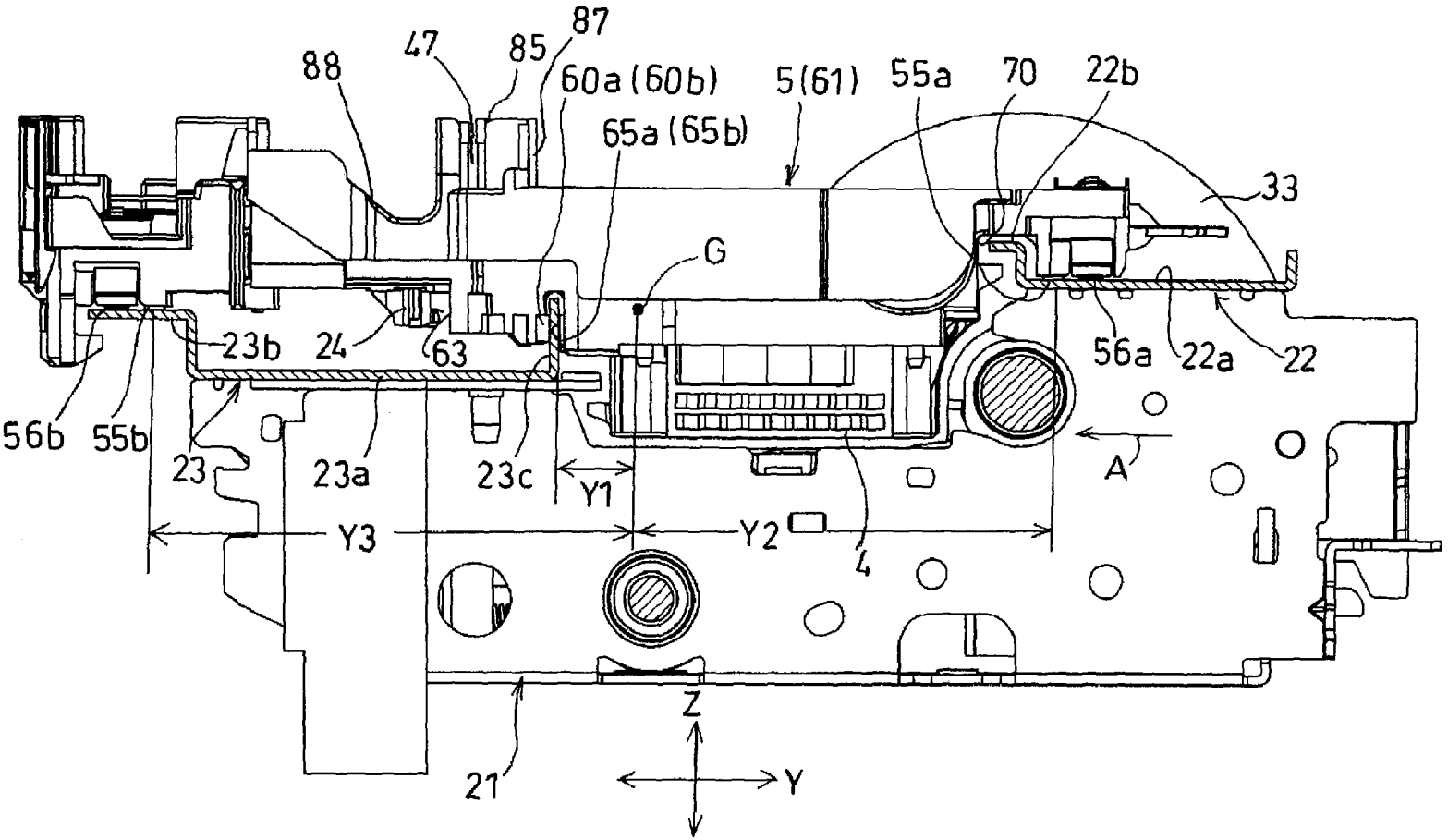
FIG. 11 is an arrow side view taken on a line XI-XI of FIG. 4.

The first guide member 22 at the upstream side in the sheet conveying direction (an arrow A direction) and the second guide member 23 at the downstream side are arranged approximately in a horizontal condition, respectively. As shown in FIGS. 9 to 11, in the side cross section of the first guide member 22, a plate portion 22*a* having the first sliding surface 51 for slidably supporting the region at the upstream side in a sheet conveying direction (the arrow A direction) of the carriage 5 in a horizontal condition and a projecting chip 22*b* having a Z-shaped side surface which is fitted in an engagement concave portion 70 on the region at the upper stream side in the sheet conveying direction in the holder body 61 to be described later of the carriage 5 are integrally formed.

As shown in FIGS. 4 to 6, FIGS. 9 to 11, and FIG. 15, the side cross section of the second guide member 23 is provided with the timing belt 24; a CR (carriage) motor 25; a horizontal wide chip 23*a* which is a reference surface in a vertical direction (a Z axial direction) for attaching the tape scale 47 or the like; a plate portion 23*b* having the second sliding surface 52 for slidably supporting the region at the downstream side in the sheet conveying direction of the carriage 5 across this horizontal wide chip 23*a* in a horizontal condition; and approximately a vertical guide chip 23*c* which is flexed upward on the region at the upstream side in the sheet conveying direction across the horizontal wide chip 23*a*.

The first sliding surface 51 in the first guide member 22 and the second sliding surface 52 in the second guide member 23 are formed on the upper surface of respective guide members 22 and 23 so as to be parallel with the lower surface of the recording head 4 of the carriage 5 (namely, the nozzle surface having a nozzle formed thereon). On the guide chip 23*c*, a third sliding surface 54 facing to the downstream side for conveyance of the sheet is formed (refer to FIG. 4 and FIG. 5). The first, second, and third sliding surfaces 51, 52, and 54 are linearly formed so as to be longer in the X axial direction, respectively.

As shown in FIGS. 11 to 13, the carriage 5 is formed by the holder body 61 made of a synthetic resin, which is shaped in an approximately rectangle in a planar view, and a head storage part 61*a* with a large downward height measurement having the recording head 4 stored in its lower surface side is formed on the region at the upstream side for conveyance of the sheet of the holder body 61. On the region at the downstream side for conveyance of the sheet of the holder body 61, an ink flowing path (not illustrated) for supplying an ink to the recording head 4 with the front ends of the plurality of ink supply tubes 20*a* to 20*d* transversely connected thereto, a connection support part 61*b* for connecting the front end of a flexible flat cable 40, and a guide groove 85 used for a sensor (a photo-coupler) of an optical penetration system 61*c* for detecting a position and a moving rate by allowing a tape scale 47 to be described in detail later to pass there through are integrally provided.

On the region at the upstream side for conveyance of the sheet of the carriage 5, one fist sliding convex portion 55*a* projected from its lower surface side and abutting against the first sliding surface 51 in the first guide member 22 is provided on the center part in the X direction of the holder body 61 (refer to FIGS. 11 to 13).

On the region at the downstream side for conveyance of the sheet of the carriage 5 (the holder body 61), the pair of right and left second sliding convex portions 55*b* projected from its lower surface side and abutting against the second sliding surface 52 in the second guide member 23 is symmetrically provided at a distance for a measurement X1 across a center line OX in the X axial direction of the holder body 61 (refer to FIGS. 11 to 13 and FIG. 15). Accordingly, in a plan view of the carriage 5 (or in a bottom view), a shape connecting respective center parts of one fist sliding convex portion 55*a* and the pair of right and left second sliding convex portions 55*b* is made into an isosceles triangle. According to this constitution, the carriage 5 is stably supported by the first and second guide members 22 and 23.

A first subsidiary sliding convex portion 56*a* provided in adjacent to the fist sliding convex portion 55*a* is configured so as to project a gap (a paper gap) PG between the nozzle surface of the cap and the platen 26 selectively downward from the lower surface of the fist sliding convex portion 55*a* in the case of making the gap PG larger than the case that the first subsidiary sliding convex portion 56*a* abuts against the fist sliding convex portion 55*a*. In the same way, a second subsidiary sliding convex portion 56*b* provided in adjacent to the pair of the second sliding convex portions 55*b* is configured so as to project the gap (the paper gap) PG between the nozzle surface of the cap and the platen 26 selectively downward from the lower surface of the second sliding convex portion 55*b* (refer to FIG. 10, FIG. 11, and FIG. 13). Further, the carriage 5 is provided with a mechanism for selectively elevating the first subsidiary sliding convex portion 56*a* and the second subsidiary sliding convex portion 56*b* (its detailed explanation is herein omitted) and their operational chips 57*a* and 57*b* are provided in the X axial direction so as to be capable of reciprocating and rising and falling. This is a constitution to selectively elevating the first subsidiary sliding convex portion 56*a* and the second subsidiary sliding convex portion 56*b* by crashing the operational chips 57*a* and 57*b* against cut-out chips 22*b* and 23*d* of the first guide member 22 and the second guide member 23 on one moving end and other end of the carriage 5 when the carriage 5 moves along the X axial direction (refer to FIG. 4, FIG. 5, FIG. 8, FIG. 9, FIG. 10, and FIG. 13 or the like).

In the carriage 5 (the holder body 61), a pair of right and left third sliding convex portions 60*a* and 60*b* (equivalent to one pair of sliding convex portions in Claims) to be abutted against the third sliding surface 54 in the second guide member 23 is integrally formed. In other words, the pair of right and left third sliding convex 60*a* and 60*b* is symmetrically provided at a distance for a measurement X2 across the center line OX in the X axial direction of the holder body 61 in FIG. 14.

Further, in the carriage 5 (the holder body 61), assuming that a pair of right and left fourth sliding convex portions 65*a* and 65*b* (equivalent to other pair of sliding convex portions in Claims) is arranged on the rear surface side across the guide chip 23*c* in a vertical direction, and this pair of fourth sliding convex portions 65*a* and 65*b* is formed on the opposite ends of a picking body 62 as a horizontally longitudinal elastic member made of a synthetic resin (refer to a part given a shadow line in FIG. 13). In FIG. 13, the pair of fourth sliding convex portions 65*a* and 65*b* is arranged on a symmetric position at a distance for a measurement X3 across the center line OX in the X axial direction of the holder body 61 (X3<X2<X1).

Figure 14:
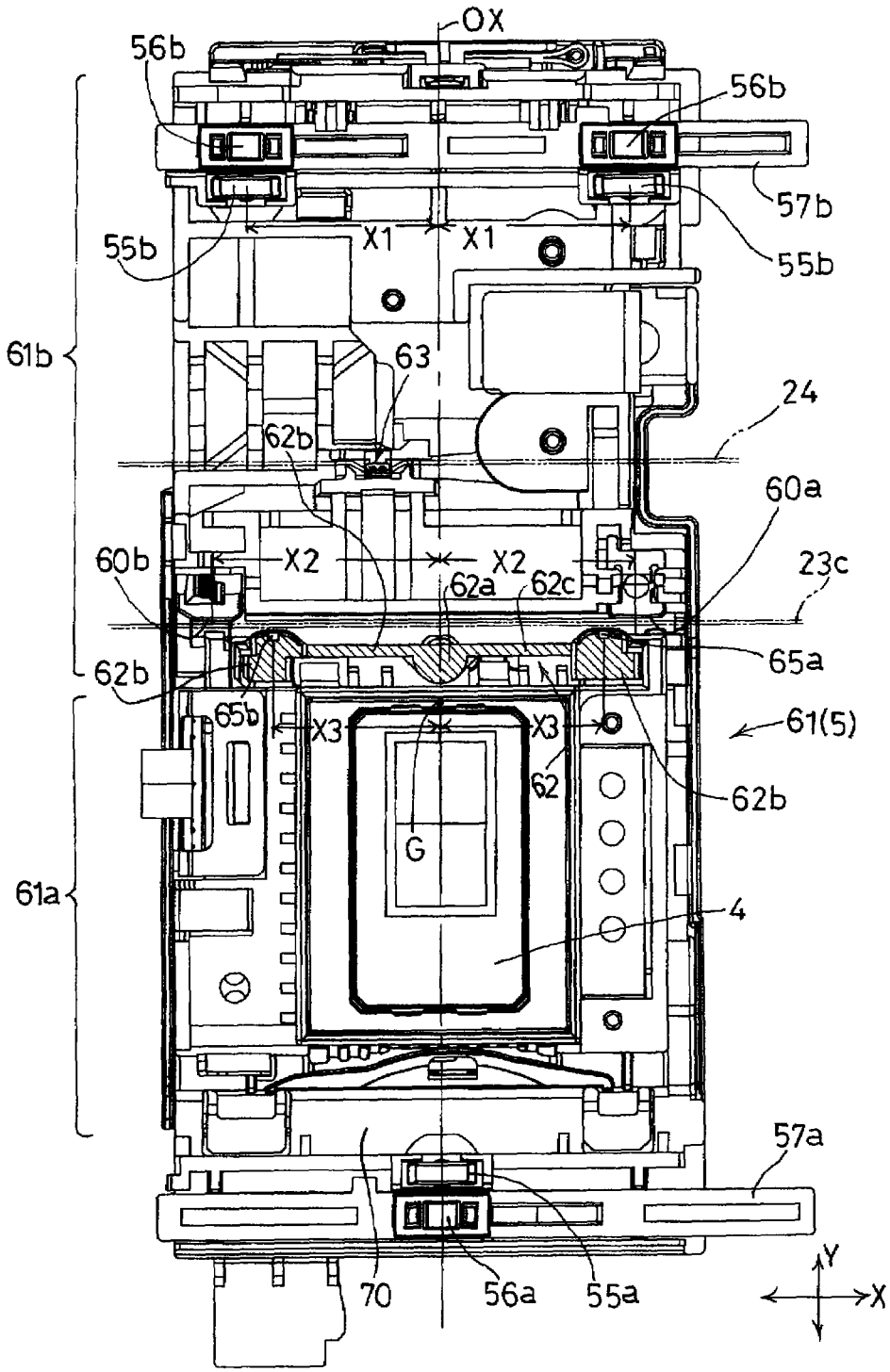
FIG. 14 is a bottom view of the carriage.

As shown in FIG. 14, right and left center parts of the picking body 62 are attaching parts 62*a* to the holder body 61 and a linking part 62*c* with a small cross section having flexibility by itself is formed between expansion parts 62*b* on the right and left opposite ends. Within respective expansion parts 62*b*, the fourth sliding convex portions 65*a* and 65*b* including a compression coil spring are arranged, and due a bias force of this compression coil spring, the guide chip 23*c* is sandwiched between the picking body 62 and the third sliding convex portions 60*a* and 60*b* to be elastically supported. Further, a space between picking body 62 and the third sliding convex portions 60*a* and 60*b* is opened in the primary scanning direction (the X axial direction) and a lower direction (the Z axial direction) (refer to FIG. 10, FIG. 11, and FIG. 13).

On the lower surface side of the carriage 5 (the holder body 61), a belt connecting part 63 to which the timing belt 24 is partially connected is provided between the second sliding convex portion 55*b* and the third sliding convex portion 60*a* (60*b*) in a subsidiary scanning direction (the Y axial direction) (refer to FIG. 10, FIG. 11, and FIG. 13). More specifically, the belt connecting part 63 has a groove, which is disposed on the lower surface side of the connection support part 61*b*, is opened on the lower surface side of the carriage 5 and in the opposite directions of the primary scanning direction, and in which the timing belt 24 is fitted.

A driving pulley 89 and a driven pulley 90 for winding the timing belt 24 there around are arranged on the opposite ends in the primary scanning direction on the upper surface side of the horizontal wide chip 23*a* in the second guide member 23 as shown in FIG. 3, FIG. 4, FIG. 5, and FIG. 14 (however, in FIG. 4 and FIG. 5, only the driven pulley 90 is shown). Thus, the second guide member 23 can carry out both functions, namely, slidably supporting of the carriage 5 and attaching means such as the driving pulley 89, the CR motor 25, and the driven pulley 90 so as to be enable to reduce a cost. Further, it is possible to reduce the sizes of the recording part 7 and the image recording apparatus 1.

Further, the second guide member has a portion (an extension portion) including the horizontal wide chip 23*a*, which extends from the elongated portion including the guide chip 23*c* into the downstream in the subsidiary scanning direction. The horizontal wide chip 23*a* is a flat shape. A portion including the horizontal wide chip 23*a* (the extension portion) may be formed separately from the portion including the guide chip 23*c* of the second guide member, and the both portions may be fixed with each other by adhesion, welding, and screwing or the like.

Further, the largest diameter D1 of the driving pulley 89 fitted on the driving axis 25*b* which is projected from a neck portion 25*a* of a carriage motor (a CR motor) 25 is formed to be smaller than a diameter D2 of the neck portion 25*a* (refer to FIG. 14). Then, with the driving pulley 89 fitted and fixed to the driving axis 25*b* in advance, the driving pulley 89 and the neck portion 25*a* are inserted into an attaching hole (equal to a diameter D2 of the neck portion 25*a*) which is formed on the horizontal wide chip 23*a* in the second guide member 23 from the lower side. In the second place, the driving motor 25 is fixed by a screw (not illustrated) from the upper surface of the horizontal wide chip 23*a*.

Thus, forming the largest diameter D1 of the driving pulley 89 smaller than the diameter D2 of the neck portion 25*a* and forming an attaching hole 23*b*, which is approximately equal to the diameter D2 of the neck portion 25*a*, to the second guide member 23, the driving pulley 89 can be fitted to the driving axis 25*b* before attaching the driving motor 25 to the second guide member 23. In addition, only the attaching hole for attaching the driving motor 25 may be formed on the horizontal wide chip 23*a* of the second guide member 23, so that a mechanical strength of the second guide member 23 is not weakened extremely. Further, as compared to the attaching structure such that the horizontal wide chip 23*a* arranged between the neck portion 25*a* and the driving pulley 89 is arranged, the driving pulley 89 can be arranged very close to the neck portion 25*a*. If a tooth surface (a tooth die) 89*a* for the timing belt 24 is formed on a circumferential surface of the driving pulley 89, no slip phenomenon is generated between the rotation of the driving motor 25 and the movement of the timing belt 24. In addition, on the upper end side of the driving pulley 89, a flange portion 89*b* for preventing detachment of the timing belt 24 is integrally formed.

The driven pulley 90 is formed in such a manner that a pulley portion 90*a* for winding the timing belt 24 there around, a shaft portion 90*b* which is projected from this pulley portion 90*a* to the both directions along the rotational center line, and a flange portion 90*c* with a large diameter which does not detach the opposite edges in the width direction of the timing belt 24 to the direction of a shaft portion 90*b* are integrally made by a synthetic resin material (refer to FIG. 14). Then, a holder 92 rotatably supporting the driven pulley 90 is elastically biased by a spring (not illustrated) in a direction separated from the driving pulley 89.

If the arrangement position between the driving pulley 89 and the driven pulley 90 is biased so that the shortest distance from the axial core (the rotational center) of the driving pulley 89 up to the guide chip 23*c* is smaller (shorter) than the shortest distance from the axial core (the rotational center) of the driven pulley 90 up to the guide chip 23*c* so as to allow an extension direction of the side chip which is connected and fixed to the carriage 5 in the timing belt 24 wounded (bridged) around the driving pulley 89 and the driven pulley 90 to be approximately in parallel with the guide chip 23*c* in a vertical direction in the second guide member 23, when the carriage 5 moves in the primary scanning direction (the X axial direction), the carriage can be pulled by the timing belt 24 so as to be in parallel with the guide chip 23*c* and the carriage can safely move along the third sliding surface 54 (the reference surface) in the guide chip 23*c*. As a result, a recording performance of an image can be improved. In this case, by arranging the driven pulley 90 with a large diameter so as to be separated from the guide chip 23*c*, the width measurement of the second guide member 23 in the direction of the arrow A can be made smaller, so that the size of the apparatus can be reduced.

Further, it is preferable that the arrangement relation of the belt connecting part 63 of the carriage 5 with respect to the driving pulley 89, the driven pulley 90, and the timing belt 24 is determined so that the carriage 5 with the force component of the tension by the timing belt 24 on the side attaching the carriage 5 is to act in direction pressing both plain plate 23 of the second guide member 23 and the guide chip 23*c* as the vertical chip. Thereby, the movement of the carriage 5 is stable as described later.

Therefore, since the carriage 5 is pressed against the guide chip 54 which is a vertical chip of the second guide member 23, the shortest distance of the belt connecting part 63 of the carriage 5 for the timing belt 24 to the driving pulley 89 and the driven pulley 90 for the third sliding surface 54 in the guide chip 23*c* is determined so as to be larger than the shortest distance on the winding portion of the timing belt 24. If the apparatus is configured in this way, due to a component force in the Y axial direction which is orthogonal to the X axial direction in which the guide chip 23*c* is elongated among tension forces F for the timing belt 24 in the belt connecting part 63, the carriage 5 is pressed against the third sliding surface 54 in the guide chip 23*c* located on the arrangement side of the timing belt 24. Therefore, a posture of the carriage 5 during movement is stable and a recording performance of an image is improved.

Figure 15:
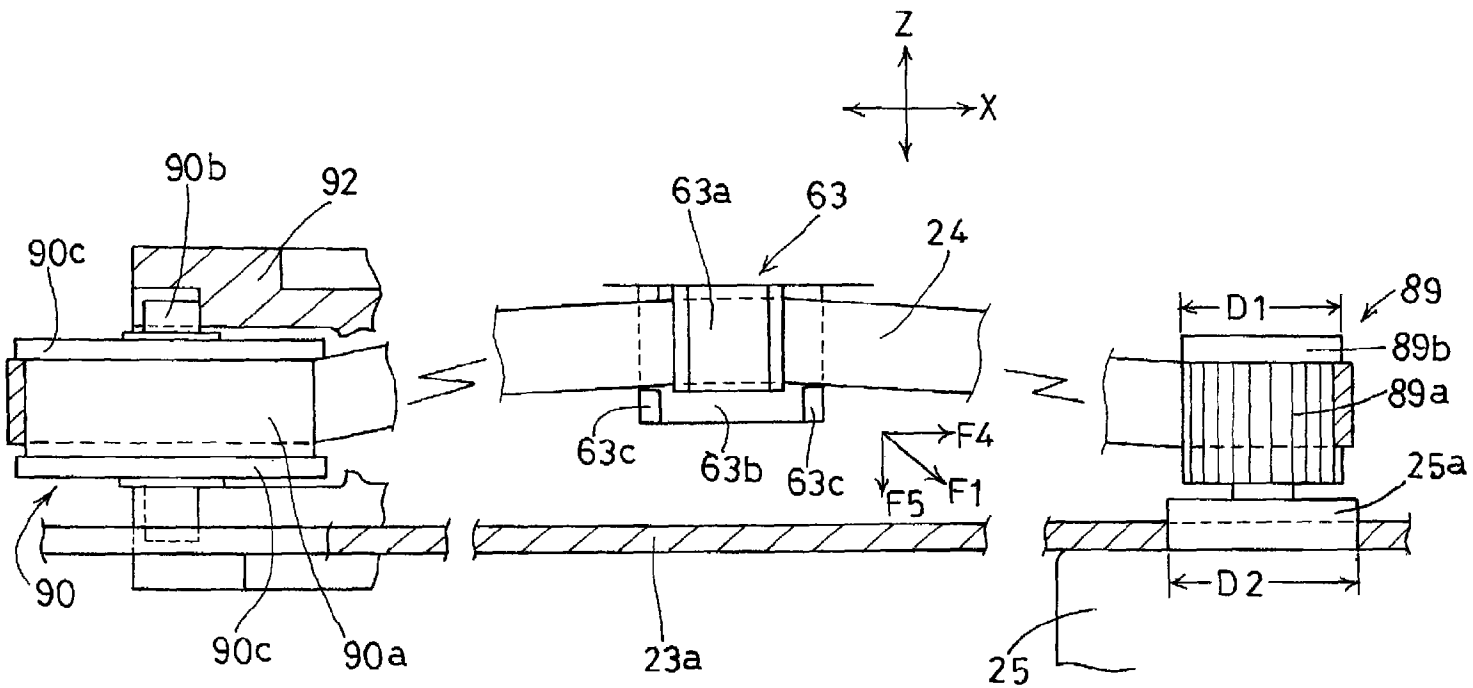
FIG. 15 is a partial notch explanatory view showing a connection state of a timing belt.
Figure 16:
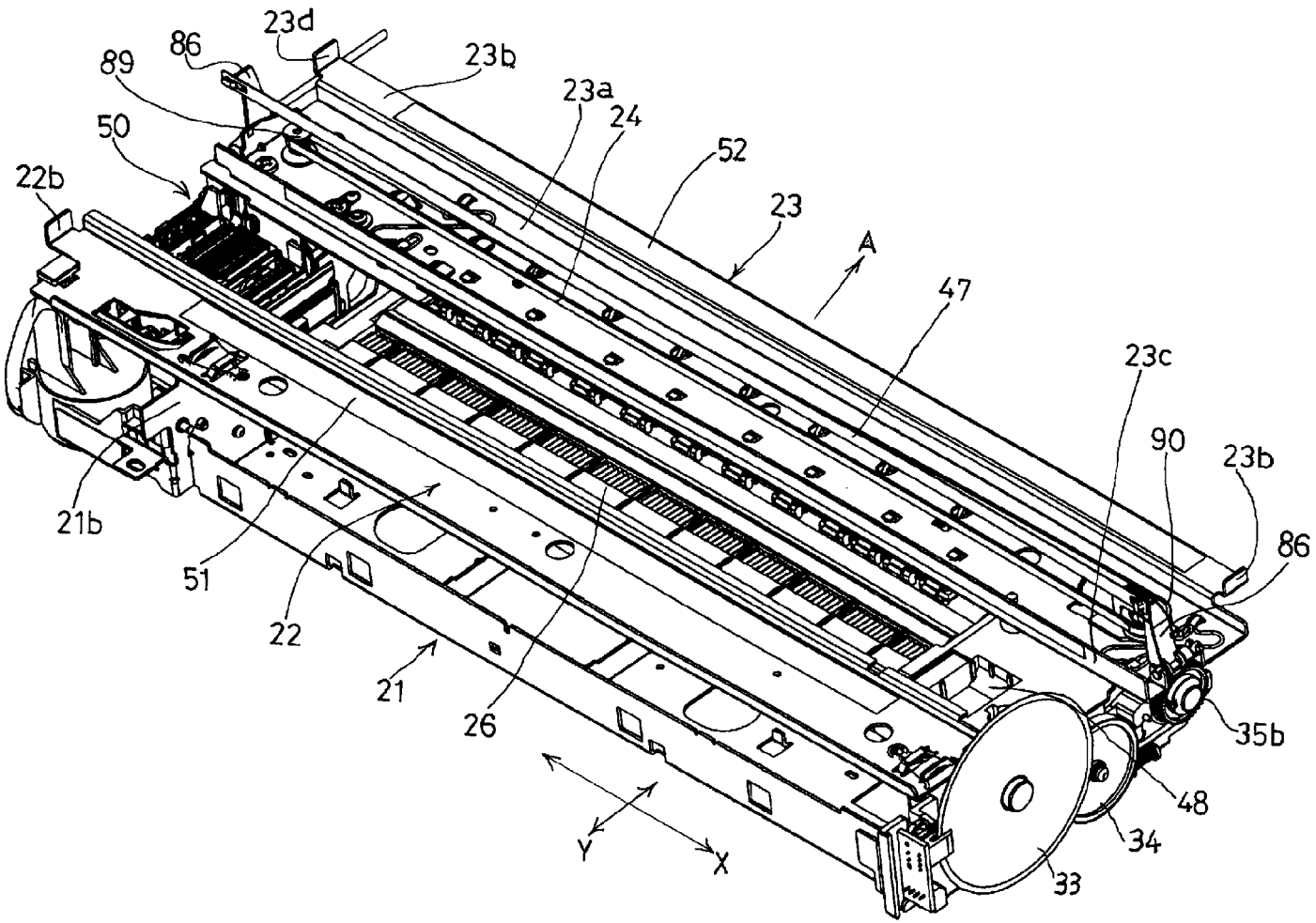
FIG. 16 is a perspective view of the recording part with the carriage removed.

On the other hand, FIG. 15 shows an embodiment for pressing and biasing the carriage 5 against the second sliding surface 52 on the upper surface of the horizontal wide chip 23*a* of the second guide member 23. The height position of the belt connecting part 63 of the carriage 5 for the timing belt 24 is biased to the upper side from the height position of the region where the timing belt 24 is winded around the driving pulley 89 and the driven pulley 90. In this case, at the belt connecting part 63, a lower edge of the timing belt 24 fitted and sandwiched between blocks 63*a* and 63*b* is engaged downward so as not to drop off by a pair of engagement nail portions 63*c* projected to the opposite sides of the lower end of the block 63*b*. Then, the upper edge of the timing belt 24 is regulated upward by the flange portion 89*b* at the upper end of the driving pulley 89 so as not to drop out and further, the flange portion 90*c* in the driven pulley 90 also regulates the upper edge of the timing belt 24 upward so as not to drop out.

According to the present embodiment, a barycentric position G of the entire carriage 5 is located on the center line OX in the X axial direction shown in FIG. 14 in the X axial direction (in a right and left width direction of the carriage 5) and as shown in FIG. 11, the barycentric position G of the entire carriage 5 is located on the side of the head storage part 61*a* in the carriage 5 and on the position with a short distance at the distance Y1 along the Y axis from the fourth sliding convex portions 65*a* and 65*b* in the Y axial direction. Furthermore, the height position of the barycentric position G of the entire carriage 5 is substantially located on the same height position as the second sliding convex portion 55*b* (the second sliding surface 52) and/or the fourth sliding convex portion 65*a*, 65*b*. In addition, the height position of the barycentric position G is substantially the same as the height position in the Z axial direction (the vertical direction) of the belt connecting part 63, and more detail, the height position of the barycentric position G is determined within the width measurement of the timing belt 24 (refer to FIG. 11 and FIG. 12). According to these structures, even when the carriage 5 starts to move in the primary scanning direction (when the carriage 5 receives an effect of acceleration, a moment around the Y axis passing through the barycentric position G can be also supported on the side of the second sliding convex portion 55*b* (the second sliding surface 52). As a result, it is possible to secure stable movement of the carriage 5 in the primary scanning direction for the rotational moment of the carriage 5 around the Y axis passing through the barycentric position G.

In addition, as shown in FIG. 4, FIG. 13, and FIG. 14, the carriage 5 is supported by one fist sliding convex portion 55*a* and a pair of right and left second sliding convex portions 55*b* in the carriage 5 to be shaped in a triangle with respect to the first guide member 22 (the first sliding surface 51) and the second guide member 23 (the second sliding surface 52) in a planar view, and further, the arrangement interval X1 in the X axial direction of the right and left second sliding convex portions 55*b* is determined to be large. Therefore, the supporting posture of the carriage around the Y axis passing through the barycentric position of the carriage 5 is stabilized. Particularly, by means of action of the component force F4 in the X axial direction due to the timing belt 24 when the carriage 5 starts to move in the primary scanning direction (the X axial direction) (when the carriage moves from a resting state with acceleration), it is possible to effectively receive a force that the carriage 5 intends to rotate around the Y axis passing through the belt connecting part 63 on the places of the pair of right and left second sliding convex portions 55*b* separated in right and left and the second sliding surface 52. As a result, removing change of the posture of the carriage 5 around the Y axis, it is possible to secure stable movement in the primary scanning direction.

According to the present embodiment, the component force F5 in the Z axial direction and the own weight of the carriage 5 among the component force F4 in the X axial direction and the component force F5 in the Z axial direction of a tension F1 of the belt connecting part 63 against the timing belt 24 may act on the first sliding surface 51 of the first guide member 22 and the second sliding surface 52 of the second guide member 23 in a downward direction of the Z axis (vertically) via the fist sliding convex portion 55*a* and the second sliding convex portions 55*b* (refer to FIG. 15). Then, as shown in FIG. 11, since a distance Y2 along the Y axis from the barycentric position G of the carriage 5 up to the first sliding convex portion 55*a* and a distance Y3 along the Y axis from the barycentric position G of the carriage 5 up to the second sliding convex portion 55*b* are large, even when the carriage 5 comes to rest and the carriage 5 moves in the X axial direction (the primary scanning direction) at a predetermined rate, it is possible to stably support the carriage 5 by the first guide member 22 and the second guide member 23 via the fist sliding convex portion 55*a* and the second sliding convex portions 55*b* largely separated along the Y axis; the gap measurement (PG) between the lower surface of the recording head 4 mounted on the carriage 5 and the sheet P on the platen 26 becomes stable, and thereby, the recording performance of the image is improved.

As shown in FIGS. 11 to 14, the third sliding surface 54 which is vertically arranged so as to be approximately orthogonal to the second sliding surface 52 is disposed on the guide chip 23*c* vertically arranged in a vertical direction in the second guide member 23 so as to be positioned between the first sliding surface 51 and the second sliding surface 52 in the Y axial direction. The carriage 5 is provided with the third sliding convex portions 60*a* and 60*b* which are slidable abutting against the third sliding surface 54 and the picking body 62 which is an elastic member for elastically biasing the fourth sliding convex portions 65*a* and 65*b* opposed to these third sliding convex 60*a* and 60*b* across the third sliding surface 54 (the guide chip 23*c*). The belt connecting part 63 is located between the second sliding convex part 55*a* and the third sliding convex part 60*a*, 60*b* in the Y axis. According to this constitution, a rotational moment that the carriage 5 intends to rotate around the X axis passing through the belt connecting part 63 due to a tension of the timing belt 24 can be received when the third sliding convex 60*a* and 60*b* disposed on the carriage 5 abut against the third sliding surface 54 in the vertical direction (the Z axial direction). As a result, removing change of the posture of the carriage 5 around the X axis, it is possible to secure stable movement in the primary scanning direction.

If the height position of the belt connecting part 63 is determined to be higher than the position of the mounting portion (the driving pulley 89 and the driven pulley 90) for the second guide member 23 of the timing belt 24, particularly when the carriage 5 starts to move in the primary scanning direction (when the carriage 5 moves from the resting state with acceleration), the component force F5 in the vertical direction of the tension of the timing belt 24 acts on the carriage 5 at the position of the belt connecting part 63 in the carriage 5. In this case, the rotational moment that the carriage 5 intends to rotate around the X axis passing through a gravity center can be effectively received on the second sliding convex portion 55*b* (the second sliding surface 51). As a result, removing change of the posture of the carriage 5 around the X axis passing through the gravity center, it is possible to secure stable movement in the primary scanning direction.

As shown in FIG. 4, FIG. 5, FIG. 7, and FIG. 8, the plurality of flexible ink supply tubes 20*a* to 20*b* for supplying the ink from the ink storage part 15 disposed on the rest position of the main body of the apparatus 2 is connected to one side portion (the connection support part 61*b*) opposed to the X axial direction of the carriage 5. When the place where the ink supply tubes 20*a* to 20 are connected to the carriage (namely, a tube connecting portion 72) are positioned between the fist sliding convex portion 55*a* and the second sliding convex portions 55*b* in the Y axial direction, a load in the vertical direction (the Z axial direction) is given to a connecting portion of the tube connecting portion 72 (namely, the connection support part 61*b*). The moment around the X axis passing through the gravity center G of the carriage 5 due to this load can be also supported on the side of the second sliding convex portion 55*b* (the second sliding surface 52). As a result, removing change of the posture of the carriage 5 around the X axis passing through the gravity center, it is possible to secure stable movement in the primary scanning direction.

In addition, in the Y axial direction, the place where the ink supply tubes 20*a* to 20 are connected to the carriage (the tube connecting portion 72) is located between the second sliding convex portion 55*b* and the third sliding convex portions 60*a* and 60*b*. In other words, since the tube connecting portion 72 is located on the third sliding convex portions 60*a* and 60*b* near the belt connecting part 63, the moment around the X axis passing through the gravity center G of the carriage 5 due to the load when the ink supply tubes 20*a* to 20 are connected can be also supported by the second sliding convex portion

55*b* (the second sliding surface 52) and the third sliding convex portions 60*a* and 60*b* (the third sliding surface 54). As a result, removing change of the posture of the carriage 5 around the X axis passing through the gravity center, it is possible to secure stable movement in the primary scanning direction.

Since the belt connecting part 63 of the carriage 5 along the Y axis is also positioned between the fist sliding convex portion 55*a* (the first sliding surface 51) and the second sliding convex portions 55*b* (the second sliding surface 52), particularly, by means of action of the component force F5 in the Z axial direction due to the timing belt 24 when the carriage 5 starts to move in the primary scanning direction (the X axial direction) (when the carriage moves from a resting state with acceleration), it is possible to effectively receive a force that the carriage 5 intends to rotate around the X axis on the first sliding convex portion 55*a* (the first sliding surface 51) and the second sliding convex portion 55*b* (the second sliding surface 52). As a result, removing change of the posture of the carriage 5 around the X axis, it is possible to secure stable movement in the primary scanning direction.

Further, as shown in FIG. 14, the pair of right and left third sliding convex portions 60*a* and 60*b* in the carriage 5 abut against the third sliding surface 54 of the guide chip 23*c* in the vertical direction in the second guide member 23 with a long interval X2 across the center line OX in the X axial direction of the carriage 5. Further, in FIG. 13, the pair of fourth sliding convex portions 65*a* and 65*b* formed on the opposite ends of the picking body 62 is arranged on a symmetric position at a distance for a measurement X3 across the center line OX in the X axial direction of the holder body 61 to elastically press the guide chip 23*c* from its rear side. A force that the carriage 5 intends to rotate around the Z axis passing through the belt connecting part 63 is generated by means of the action of the component force F4 in the X axial direction due to the timing belt 24 when the carriage 5 starts to move in the primary scanning direction (the X axial direction) (when the carriage moves from a resting state with acceleration). This force can be effectively received on the pair of right and left third sliding convex portions 60*a* and 60*b* separated right and left; the pair of fourth sliding convex portions 65*a* and 65*b*; and the third sliding surface 54. As a result, removing change of the posture of the carriage 5 around the Z axis, it is possible to secure stable movement in the primary scanning direction.

Next, the arrangement relation between the linear encoder and the ink supply tube and the constitution for maintaining a detection accuracy of the linear encoder will be described. The linear encoder according to the present embodiment is an optical system and this linear encoder is formed by the tape scale 47 which is left at rest and the optical penetration sensor (the photo coupler) 61*c* which is provided to the carriage 5. As shown in FIG. 4, FIG. 5, FIGS. 8 to 13, and FIG. 16, the band-like tape scale 47 is extended as a long line along the X axial direction on the upper surface of the second guide member 23 up to the opposite ends of the second guide member 23. The opposite ends of the tape scale 47 are supported by a supporting chip 86 lifted from the right and left opposite ends of the second guide member 23. This band-like tape scale 47 is arranged so that a detection surface (a surface where slits arranged at predetermined intervals in the X axial direction are formed, not illustrated) follows a vertical direction.

On the other hand, on the upper surface of an upper cover 66 made of a synthetic resin to cover the upper surface of the holder body 61 in the carriage 5, a shade wall 87 longer in the X axial direction having the guide groove 85 which is opened at its upper side so that the tape scale 47 can pass through in the X axial direction and is opened also in the X axial direction is integrally formed. On the middle portion within the guide groove 85, the photo coupler 61*c* as signal detecting means to be able to pass through across the front and rear surfaces of the tape scale 47 is arranged (refer to FIGS. 8 to 10). According to the above-described constitution, the position of the carriage 5 from a home position (the right end of FIG. 4 according to the embodiment) and a moving rate when the carriage 5 reciprocates along the X axis are detected.

The upper cover 66 detachable from the upper surface of the holder body 61 is arranged over the upper surfaces of the storage part 61*a* and the connection support part 61*b*. On the part in the upper cover 66 covering the storage part 61*a*, a control substrate (not illustrated) for outputting a predetermined driving signal to the recording head 4 is arranged in response to a signal sent from the flexible flat cable 40. Detachment of the upper cover 66 is necessary for maintenance such as exchange of the control substrate and the ink supply tubes 20*a* to 20*d* to be described later.

Figure 8:
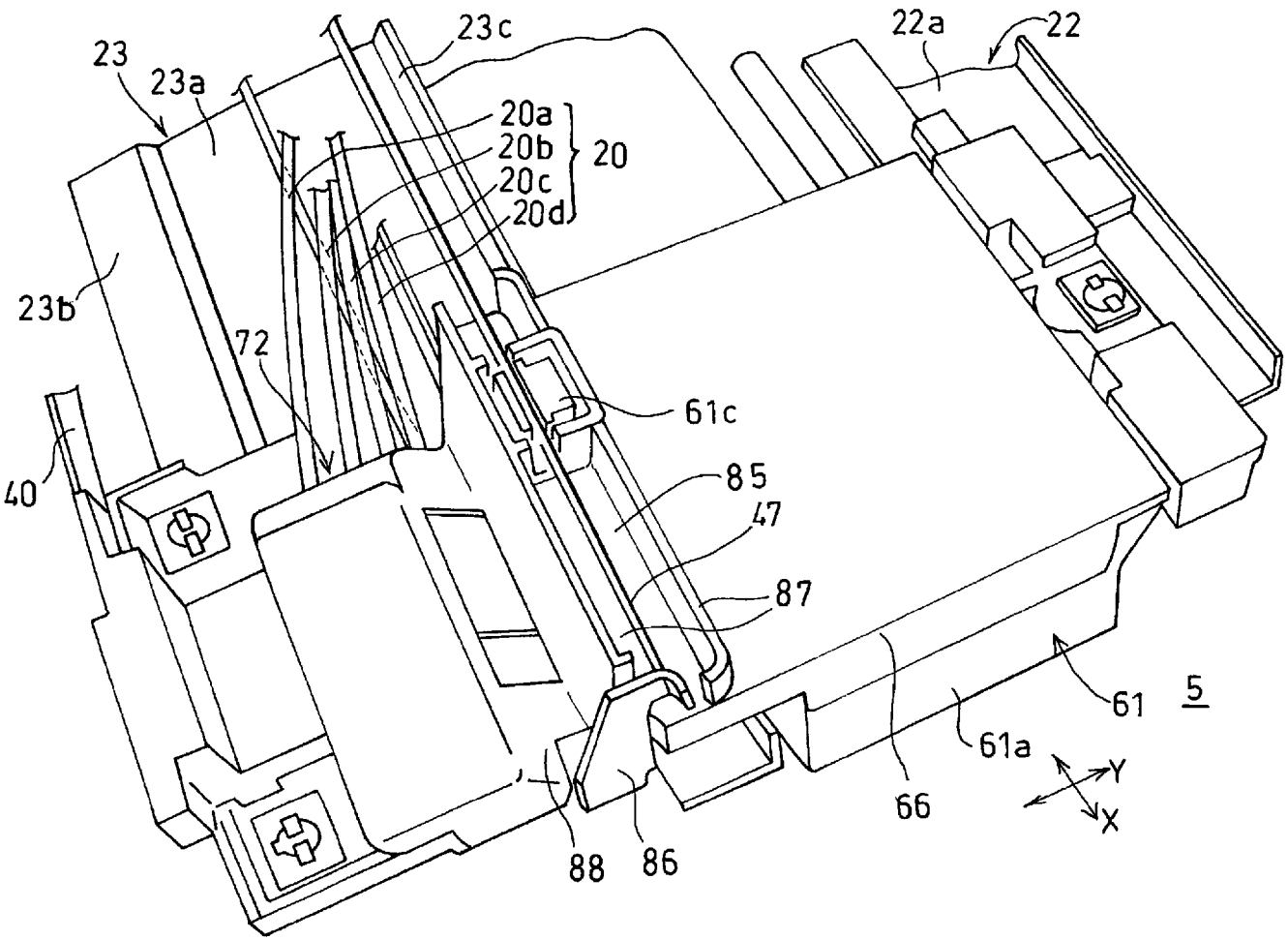
FIG. 8 is a partial notch enlarged perspective view of the recording part.

As shown in FIG. 8, a clearance groove (a concave portion) 88 having a cross section which is opened upward and formed in approximately a V-shape is integrally formed between the storage part 61*a* and the connection support part 61*b* (more specifically, between the shade wall 87 and the tube connecting portion 72 of the ink supply tubes 20*a* to 20*d*) on the upper cover 66.

Next, the arrangement constitution of the ink supply tube 20 having a flexibility to always connect each ink cartridge 19 stored in the ink storage part 15 to the recording head 4 in the recording part 7 will be described in detail. According to the embodiment, respective ink supply tubes 20*a* to 20*d* are independent tubes made of a synthetic resin having flexibility.

As shown in FIGS. 3 to 5, FIG. 7, and FIG. 8, the plurality of ink supply tubes 20 (according to the embodiment, four) is elongated from its one side end (a right end in FIG. 4) along the X axial direction in a direction of other end (a left end in FIG. 4) on the upper surface of a lower cover body 29. In this case, root portions of the all ink supply tubes 20*a* to 20*d* are aligned in tandem in approximately a vertical direction.

The middle portions of the all ink supply tubes 20*a* to 20*d* are bundled via a movable wire-like bundling member 71 from the lower cover body 29 up to the upper surface side of the second guide member 23. In the all ink supply tubes 20*a* to 20*d*, their middle portions are curved and are twisted, and their front ends are connected in approximately a horizontal line on the connecting portion (the tube connecting portion 72) which is disposed on one side of the connection support part 61*b* (the left end in FIG. 4 and FIG. 5).

According to the present embodiment, the flexible flat cable 40 is provided, which transfers a command signal allowing to selectively inject ink drops from the nozzle of the recording head 4 which is mounted on the carriage 5 from the control part (not illustrated) which is disposed at the side of the main body of the recording apparatus 2. The flexible flat cable 40 is arranged on the area where the ink supply tubes 20*a* to 20*d* pass when the carriage 5 reciprocates in the X axial direction (the primary scanning direction) approximately in parallel with a direction of extension of the ink supply tubes 20 so that the wide surface of the flexible flat cable 40 is aligned in a vertical direction (refer to FIG. 4 and FIG. 5). In addition, the curved portion of the flexible flat cable 40 is located inside of a radius of the curved portions of the ink supply tubes 20*a* to 20*d*.

Since there is the above-described curved portions on the ink supply tubes 20*a* to 20*d*, due to a restoring force of the ink supply tubes 20*a* to 20*d* such that the radiuses of these curved portions intent to be larger, a rotational moment around the Z axis acts on the tube connecting portion 72 and the carriage 5.

This acting force can be effectively received on the pair of right and left third sliding convex portions 60*a* and 60*b* separated right and left; the pair of fourth sliding convex portions 65*a* and 65*b*; and the third sliding surface 54. As a result, removing change of the posture of the carriage 5 around the Z axis, it is possible to secure stable movement in the primary scanning direction.

The constitution for maintaining the detection accuracy of the linear encoder will be further described.

Figure 7:
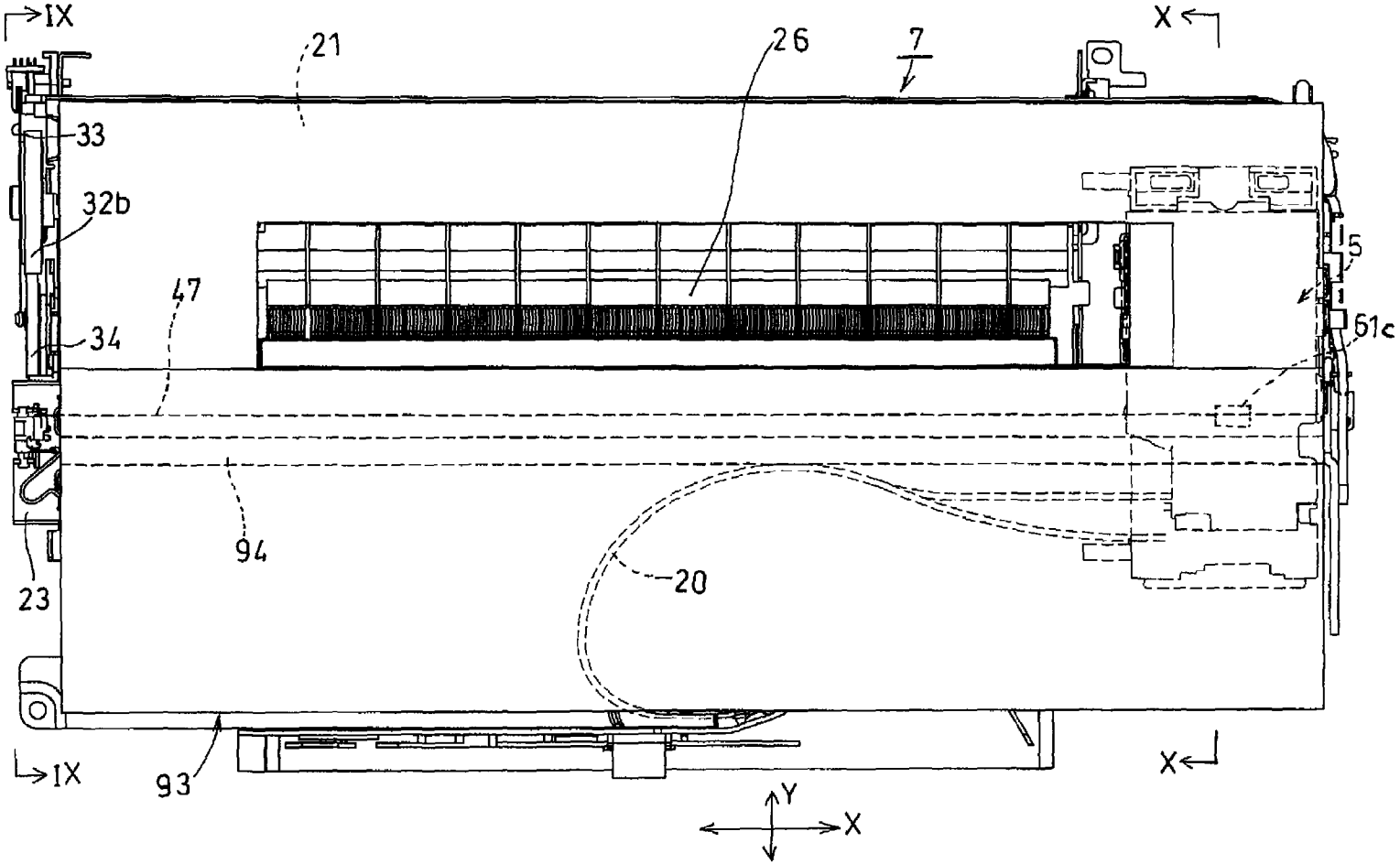
FIG. 7 is a plan view of the recording part with the upper cover body mounted thereon.

As shown in FIG. 7, an upper cover body 93, which is shaped in an approximately rectangle in a planar view and is made of a synthetic resin, is detachably arranged on the upper surface of the recording part 7. On the lower surface side of this upper cover body 93, a rib portion (partition) 94 as a partition wall is provided across the entire length of a moving range of the carriage 5 so that the tape scale 47 does not interfere with the ink supply tubes 20*a* to 20*d* (they do not contact with each other). This rib portion 94 has a triangle cross section which is thin at the lower end side and becomes thicker toward the upper side. As shown in FIG. 9, FIG. 10, and FIG. 12, the side surfaces opposed to the ink supply tubes 20*a* to 20*d* are formed on the inclined surface which is directed to the downstream side in the subsidiary scanning direction toward the upper side. The middle portions of the ink supply tubes 20*a* to 20*d* contacting this inclined surface are pressed downward, it is possible to reliably prevent contact with the tape scale 47.

Further, the rib portion (partition) 94 as the partition wall is not necessarily provided across the entire length of the moving rage of the carriage 5. As long as the tape scale 47 and the ink supply tubes 20*a* to 20*d* act so that they do not interfere with each other (they do not contact with each other), the rib portion 94 may be a portion (partition) which is provided on a part of the movement range of the carriage 5.

When the carriage 5 moves (reciprocates) along the X axis, the curved portions of the ink supply tubes 20*a* to 20*d* can be modified so that the radiuses thereof are made larger. The second guide member has a portion (an extension portion) including the horizontal wide chip 23*a*, which is elongated from the taper portion including the guide chip 23*c* up to the downstream side in the subsidiary scanning direction. When the carriage 5 moves (reciprocates) along the X axis, a position of the partial curved portion is moving on the upper side of the portion (the extension portion) including the horizontal wide chip 23*a*. In such a case, the middle portions of the ink supply tubes 20*a* to 20*d* may slidably contact the rib portion 94 (this may be a partition as described above). Therefore, smooth movement of the ink supply tubes 20*a* to 20*d* cannot be prevented. The surface of the tape scale 47 and the ink supply tubes 20*a* to 20*d* do not contact with each other because they are blocked by the rib portion 94, and the detection accuracy of the linear encoder is not deteriorated (lowered) due to adhesion of the ink to the tape scale 47. In addition, since the tape scale 47 passes the upper surface side of the carriage 5, the tape scale 47 is vertically separated from the recording head 4 on the lower surface side of the carriage 5. Therefore, it is difficult to adhere ink mist generated upon operation of recording the image on the surface of the tape scale 47, so that the detection accuracy of the liner encoder can be maintained without deterioration. It is unnecessary for other wiper cleaning to wipe the ink mist adhered to the tape scale 47 in other wiper cleaning. Since the tape scale 47 does not contact the ink supply tubes 20*a* to 20*d* due to the rib portion 94, the oscillation generated by the tape scale 47 when it contacts the ink supply tubes 20*a* to 20*d* is completely removed. Further, the detection accuracy due to the linear encoder is not deteriorated.

Then, when the carriage 5 is moving along the X axis, since the clearance groove 88 through which the rib portion 94 can pass is formed on the carriage 5, it is not necessary to arrange the upper cover body 93 being largely separated from the upper surface of the carriage 5. Thus, there is an advantage such that the height measurement of the entire image recording apparatus 1 can be made smaller and the size of the apparatus is reduced.

In place of the above-described embodiment, according to another embodiment, the photo coupler 61*c* as the place where the tape scale 47 passes through and the signal detecting means is arranged between the pair of right and left third sliding convex portions 60*a* and 60*b*, the pair of fourth sliding convex portions 65*a* and 65*b*, and the tube connecting portion 72 in the sheet feeding roller, at the lower side of the carriage 5 which sandwiching the guide chip 23*c* in vertical direction in the second guide member 23, and on the lower surface side of the connection support part 61*b*. By forming the rib portion as the partition wall which is shaped in a flat plate projected upward from the horizontal wide portion 23*a* in the second guide member 23 longer along the X axis, as same as an embodiment, it is possible to remove contact between the tape scale 47 and the ink supply tubes 20*a* to 20*d*. This embodiment also has a function as the partition wall that the second guide member 23, which is having the horizontal wide chip 23*a* and the upward guide chip 23*c*, entirely prevents the ink mist in response to injection of the ink from the recording head 2 from floating toward the side of the tape scale 47.

According to an embodiment, the apparatus can move in the primary scanning direction as being supported by the opposite guide members only by the own weight of the carriage with respect to the first siding surface on the upper surface of the horizontal first guide member and the second siding surface on the upper surface of the second guide member.

Then, even if the curved portion at the middle portion is modified so that the radius of the curved portion at the middle portion of the ink supply tube is made larger, the ink supply tube merely contacts the partition wall, so that smooth movement of the ink supply tube cannot be prevented. Then, the surface of the tape scale does not contact to the ink supply tube because they are blocked by the partition wall and there is an advantage such that the detection accuracy of the linear encoder is not deteriorated (lowered) due to adhesion of the ink to the tape scale.

According to an embodiment, since the concave surface through which the partition wall can pass is formed on the lower surface or the upper surface of the carriage, the partition wall can be arranged in the vicinity of the lower surface or the upper surface of the carriage. Therefore, there is an advantage such that the height measurement of the entire image recording apparatus can be made smaller and the size of the apparatus is reduced.

According to an embodiment, since the tape scale passes through the upper surface side of the carriage, it can be said that the tape scale is largely separated in a vertical direction from the recording head located on the lower surface side of the carriage and it is difficult to adhere the ink mist generated upon the image recording operation on the surface of the tape scale. As a result, the detection accuracy of the liner encoder can be maintained without deterioration. In addition, since the tape scale does not always contact the ink supply tube due to the rib portion as the partition wall, the oscillation generated by the tape scale when it contacts the ink supply tubes is completely removed and the detection accuracy doe to the linear encoder is not deteriorated.

According to an embodiment, the tube connecting portion to the carriage of the ink supply tube is arranged on the downstream side in the subsidiary scanning direction from the arrangement position of the tape scale, and the cross sectional shape of the rib portion in the upper cover body is formed on the inclined surface which is directed toward the downstream side in the subsidiary scanning direction as at least the side on its downstream side is directed toward the upper side.

Accordingly, the middle portion of the ink supply tube contacting the inclined surface is pressed downward, so that there is an advantage such that contact with the tape scale can be reliably prevented.

According to an embodiment, the apparatus can move in the primary scanning direction with the carriage supported by the first sliding surface on the upper surface of the horizontal first guide member and the second sliding surface on the upper surface of the second guide member.

Then, the third sliding surface which is vertically arranged so as to be substantially orthogonal to the second sliding surface is provided so as to be located between the first sliding surface and the second sliding surface in the subsidiary scanning direction. The carriage is provided with an elastic member for elastically biasing one pair of sliding convex portions which can slide abutting against the third sliding surface and other pair of sliding convex portions opposed to the one pair of the sliding convex portions across the third sliding surface in a direction of the third sliding surface. Therefore, the moment around the vertical axis of the curved portion of the plural ink supply tubes connected to one side portion of the carriage intending to be widened can be received by abutting one pair of sliding convex portions provided to the carriage against the third sliding surface in the vertical direction (the Z axial direction), and it is possible to remove change of the posture of the carriage around the vertical axis.

According to an embodiment, since the belt connecting part in the carriage along the subsidiary scanning direction is positioned between the second sliding surface and the third sliding surface, by means of a tension of the no-end belt, particularly, when the carriage starts to move in the primary scanning direction (when the carriage moves from the resting state with acceleration), the force that the carriage intends to rotate around the axis in the primary scanning direction passing through the belt connecting part and the vertical axis can be effectively received on the second sliding surface and the third sliding surface. As a result, reducing change of the posture of the carriage around the axis in the primary scanning direction and the vertical axis, it is possible to secure stable movement in the primary scanning direction.

As this description may be embodied in several forms without departing from the spirit of essential characteristics thereof, the present embodiments are therefore illustrative and not restrictive, since the scope is defined by the appended claims rather than by description preceding them, and all changes that fall within metes and bounds of the claims, or equivalence of such metes and bounds thereof are therefore intended to be embraced by the claims.

What is claimed is:

1. An image recording apparatus comprising:

a recording head for recording an image on a recording medium;

an ink supply source for supplying an ink to the recording head through an ink tube;

a carriage for mounting the recording head thereon, reciprocating in a primary scanning direction;

first and second guide members for supporting the carriage thereacross and guiding reciprocating movement of the carriage, the second guide members being disposed downstream from the first guide member in a subsidiary scanning direction perpendicular to the primary scanning direction;

a scale provided on the second guide member along the primary scanning direction;

a detector provided on the carriage, for detecting a reciprocating position of the carriage in corporation with the scale; and a partition wall which is disposed in the vicinity of the scale and is not in contact with the scale, for separating at least a part of the ink tube from the scale.

2. The image recording apparatus according to claim 1, wherein the carriage includes a concave portion to which the partition fits with a gap.

3. The image recording apparatus according to claim 1, further comprising a cover for covering at least a reciprocating movement area of the carriage, wherein the partition is formed on the cover.

4. The image recording apparatus according to claim 3, wherein a cross section on a plane perpendicular to the primary scanning direction of the partition is approximately a triangle of which the cover shares one side.

5. The image recording apparatus according to claim 3, wherein, in a cross sectional view of the partition on a plane orthogonal to the primary scanning direction, a length of a part shared by the cover is larger than a length of a remote end from the cover, in the subsidiary scanning direction.

6. The image recording apparatus according to claim 5, wherein, in a cross sectional view of the partition on a plane orthogonal to the primary scanning direction, a side downstream in the subsidiary scanning direction is a slope which comes into contact with the cover downstream from the remote end in the subsidiary scanning direction.

7. The image recording apparatus according to claim 3, wherein the partition provided along with an entire reciprocating movement range of the carriage in the primary scanning direction is formed in a rib shape.

8. The image recording apparatus according to claim 1, wherein the ink tube has flexibility and has a curved portion, and at least a part of the curved portion moves over the second guide member of the second guide member in response to the reciprocating movement of the carriage.

9. The image recording apparatus according to claim 8, wherein a cross section on a plane perpendicular to the primary scanning direction of the partition is approximately a triangle of which the cover shares one side.

10. The image recording apparatus according to claim 8, wherein, in a cross sectional view of the partition on a plane orthogonal to the primary scanning direction, a length of a part shared by the cover is larger than a length of a remote end from the cover, in the subsidiary scanning direction.

11. The image recording apparatus according to claim 10, wherein, in a cross sectional view of the partition on a plane orthogonal to the primary scanning direction, a side downstream in the subsidiary scanning direction is a slope which comes into contact with the cover downstream from the remote end in the subsidiary scanning direction.

12. The image recording apparatus according to claim 8, wherein the partition provided along with an entire reciprocating movement range of the carriage in the primary scanning direction is formed in a rib shape.

13. The image recording apparatus according to claim 1, further comprising an enlargement which extends from the carriage downstream in the subsidiary scanning direction, wherein the carriage includes a concave portion to which the partition fits with a gap, and the concave portion is formed in the enlargement of the carriage.

14. The image recording apparatus according to claim 1, wherein the partition is provided across an entire reciprocating movement range of the carriage in the primary scanning direction to be formed in a rib shape.

15. The image recording apparatus according to claim 1, further comprising:

a first sliding surface extending from the first guide member in the primary scanning direction;

an extension portion formed in a flat shape which extends from the second guide member downstream in the subsidiary scanning direction;

a second sliding surface provided on the extension portion of the second guide member in the primary scanning direction, the first and second sliding surfaces being parallel to the primary scanning direction and the subsidiary scanning direction; and a third sliding surface provided on the second guide member approximately orthogonally to the second sliding surface between the first and second sliding surfaces, wherein the carriage comes into contact with the first, second, and third sliding surfaces;

the carriage includes:

a pair of sliding protrusions slidably abutting against the third sliding surface; and another pair of sliding protrusions opposing to the pair of sliding protrusions for pinching the third sliding surface in corporation with the pair of sliding protrusions; and the another pair of sliding protrusions includes an elastic member for biasing the third sliding surface.

16. The image recording apparatus according to claim 15, wherein, with respect to a line passing through a center of the recording head in the subsidiary scanning direction, one of the pair of sliding protrusions locates symmetrically to the other of the pair of sliding protrusions, and one of the another pair of sliding protrusions locates symmetrically to the other of the another pair of sliding protrusions.

17. The image recording apparatus according to claim 1, further comprising:

a first sliding surface extending from the first guide member in the primary scanning direction;

an extension portion formed in a flat shape which extends from the second guide member downstream in the subsidiary scanning direction;

a second sliding surface provided on the extension portion of the second guide member in the primary scanning direction, the first and second sliding surfaces being parallel to the primary scanning direction and the subsidiary scanning direction;

a third sliding surface provided on the second guide member approximately orthogonally to the second sliding surface between the first and second sliding surfaces; and a endless belt which is provided on the extension portion along the primary scanning direction and to a part of which the carriage is fixed through a fixing portion, wherein the carriage comes into contact with the first, second, and third sliding surfaces, the endless belt is movable in the primary scanning direction, and the fixing portion locates between the second sliding surface and the third sliding surface in the subsidiary scanning direction.

* * * * *